US008236711B1

(12) United States Patent
Wang

(10) Patent No.: US 8,236,711 B1
(45) Date of Patent: Aug. 7, 2012

(54) FLEXIBLE SPIKE AND KNIFE RESISTANT COMPOSITE

(75) Inventor: Yunzhang Wang, Duncan, SC (US)

(73) Assignee: Milliken & Company, Spartanburg, SC (US)

( * ) Notice: Subject to any disclaimer, the term of this patent is extended or adjusted under 35 U.S.C. 154(b) by 1091 days.

(21) Appl. No.: 12/157,668

(22) Filed: Jun. 12, 2008

(51) Int. Cl.
*B32B 27/04* (2006.01)
*B32B 27/12* (2006.01)

(52) U.S. Cl. ..... 442/134; 442/200; 442/239; 442/243; 442/244; 442/245; 442/246; 442/247; 442/255; 442/263; 442/267; 442/268; 442/269; 428/102; 428/201; 428/212

(58) Field of Classification Search ..... 442/134, 442/200, 239, 243, 244, 245, 246, 247, 255, 442/263, 267, 268, 269; 428/102, 201, 212
See application file for complete search history.

(56) References Cited

U.S. PATENT DOCUMENTS

| | | | | |
|---|---|---|---|---|
| 4,309,487 | A | 1/1982 | Holmes | 428/516 |
| 4,403,012 | A | 9/1983 | Harpell et al. | 428/290 |
| 4,551,296 | A | 11/1985 | Kavesh et al. | 264/177 |
| 4,650,710 | A | 3/1987 | Harpell et al. | 428/263 |
| 4,916,000 | A | 4/1990 | Li et al. | 428/105 |
| 4,989,266 | A | 2/1991 | Borgese et al. | 2/2.5 |
| 5,124,195 | A | 6/1992 | Harpell et al. | 428/245 |
| 5,437,905 | A | 8/1995 | Park | 428/105 |
| 5,443,882 | A | 8/1995 | Park | 428/103 |
| 5,443,883 | A | 8/1995 | Park | 428/103 |
| 5,536,553 | A * | 7/1996 | Coppage et al. | 428/102 |
| 5,547,536 | A | 8/1996 | Park | 156/292 |
| 5,565,264 | A | 10/1996 | Howland | 428/229 |
| 5,578,358 | A | 11/1996 | Foy et al. | 428/104 |
| 5,619,748 | A | 4/1997 | Nelson et al. | 2/2.5 |
| 5,622,771 | A | 4/1997 | Chiou et al. | 428/219 |
| 5,677,029 | A | 10/1997 | Prevorsek et al. | 428/113 |
| 5,724,670 | A | 3/1998 | Price | 2/2.5 |
| 5,837,623 | A | 11/1998 | Howland | 442/189 |

(Continued)

FOREIGN PATENT DOCUMENTS

GB 2 234 156 1/1991

(Continued)

OTHER PUBLICATIONS

U.S. Appl. No. 11/519,134, filed Sep. 11, 2006, Eleazer et al.

(Continued)

*Primary Examiner* — Andrew Piziali
(74) *Attorney, Agent, or Firm* — Cheryl J. Brickey

(57) ABSTRACT

A flexible spike and knife resistant composite incorporating a stack of at least ten consolidated layer groupings. Each layer grouping has a normalized stiffness of less than about 5 g/g/m$^2$ as tested by a modified ASTM Test Method D6828-02 and contains one or two spike resistant textile layers, an adhesive layer, and one or two knife resistant textile layers. The spike resistant textile layers contain a plurality of interlocked yarns or fibers, where the yarns or fibers have a tenacity of about 8 or more grams per denier and the fiber size is less than ten denier per filament. The knife resistant textile layers contain monoaxially drawn fiber elements, where the fiber elements have an aspect ratio of greater than one and have a size greater than 100 denier per filament. The fiber elements of the knife resistant textile layer are bonded to each other or to the spike resistant layer.

20 Claims, 12 Drawing Sheets

U.S. PATENT DOCUMENTS

| | | | | |
|---|---|---|---|---|
| 5,861,202 | A | 1/1999 | Kimura et al. | 428/105 |
| 5,960,470 | A | 10/1999 | Bachner, Jr. | 2/2.5 |
| 5,976,996 | A | 11/1999 | Howland | 442/189 |
| 6,045,923 | A | 4/2000 | Kok et al. | 428/517 |
| 6,054,086 | A | 4/2000 | Kurihara et al. | 264/147 |
| 6,103,646 | A | 8/2000 | Chiou | 442/244 |
| 6,127,291 | A | 10/2000 | Coppage, Jr. et al. | 442/135 |
| 6,133,169 | A | 10/2000 | Chiou et al. | 442/234 |
| 6,156,679 | A | 12/2000 | Takaoka et al. | 442/327 |
| 6,162,746 | A | 12/2000 | Chiou | 442/134 |
| 6,475,936 | B1 | 11/2002 | Chiou | 442/203 |
| 6,509,105 | B2 | 1/2003 | Olvey | 428/481 |
| 6,534,426 | B1 | 3/2003 | Chiou | 442/203 |
| 6,562,435 | B1 | 5/2003 | Brillhart, III et al. | |
| 6,662,369 | B2 | 12/2003 | Fuchs et al. | 442/239 |
| 6,737,368 | B2 | 5/2004 | Chiou | 442/134 |
| 6,786,126 | B2 | 9/2004 | Sargent | 89/36.02 |
| 6,824,863 | B1 | 11/2004 | Kitayama et al. | 428/299.7 |
| 6,846,758 | B2 | 1/2005 | Bhatnagar et al. | 442/135 |
| 6,861,378 | B2 | 3/2005 | Cunningham et al. | 442/135 |
| 6,893,989 | B2 | 5/2005 | Breukers | 442/135 |
| 6,949,280 | B2 | 9/2005 | Brillhart, III et al. | 428/105 |
| 7,288,493 | B2 | 10/2007 | Bhatnagar et al. | 442/134 |
| 7,294,383 | B2 | 11/2007 | Callaway et al. | 428/86 |
| 7,294,384 | B2 | 11/2007 | Eleazer et al. | 428/86 |
| 7,300,691 | B2 | 11/2007 | Callaway et al. | 428/86 |
| 7,318,961 | B2 | 1/2008 | Loos et al. | 428/516 |
| 2004/0242103 | A1 | 12/2004 | Loos et al. | 442/185 |
| 2005/0003727 | A1 | 1/2005 | Chiou | 442/239 |
| 2006/0151104 | A1 | 7/2006 | Jacobs et al. | 156/308.2 |
| 2007/0071960 | A1 | 3/2007 | Eleazer et al. | 428/297.7 |
| 2007/0105471 | A1 | 5/2007 | Wang et al. | 442/301 |
| 2008/0124513 | A1 | 5/2008 | Eleazer et al. | 428/113 |

FOREIGN PATENT DOCUMENTS

| | | |
|---|---|---|
| GB | 2 286 798 | 8/1995 |
| WO | WO 00/08411 | 2/2000 |
| WO | WO 00/37876 | 6/2000 |
| WO | WO 2006/136323 | 12/2006 |
| WO | WO 2007/047508 | 4/2007 |

OTHER PUBLICATIONS

Patent Cooperation Treaty PCT International Search Report. Date of Mailing: Sep. 29, 2009. International Application No. PCT/US2009/000674. International Filing Date: Feb. 3, 2009.

* cited by examiner

FIG. —1—

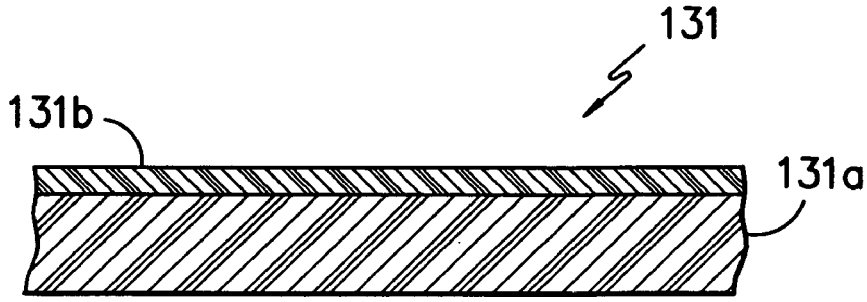
FIG. –3A–
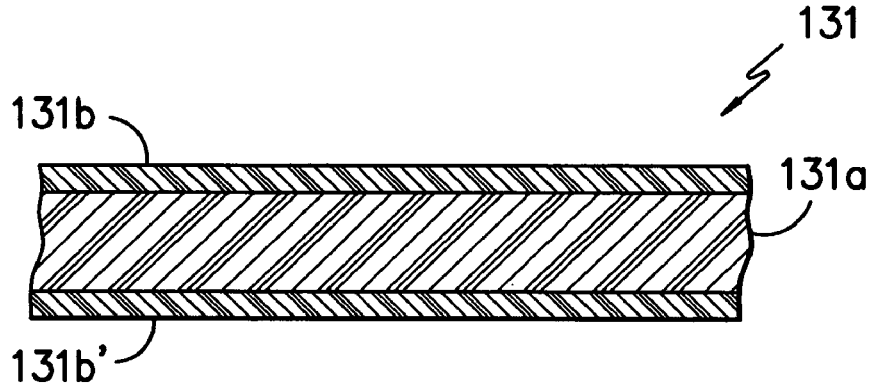
FIG. –3B–
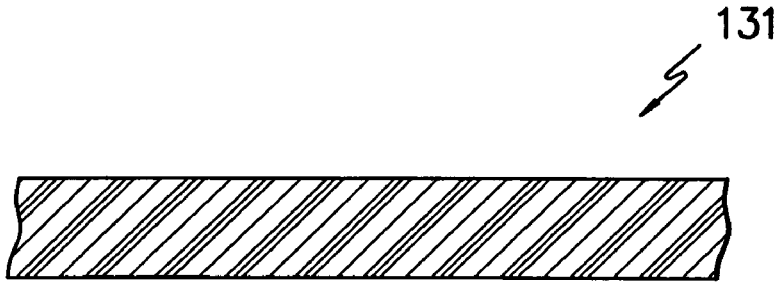
FIG. –3C–

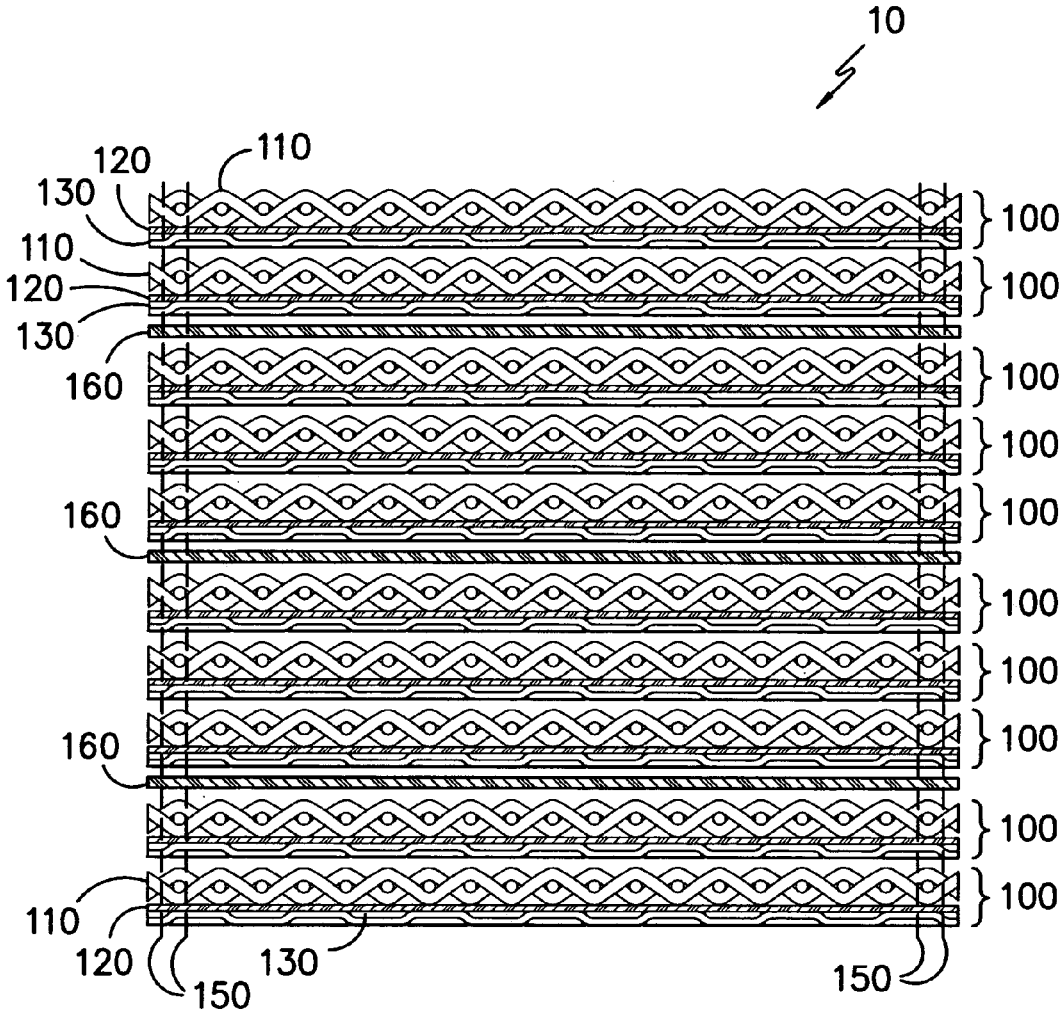
FIG. –13–

FLEXIBLE SPIKE AND KNIFE RESISTANT COMPOSITE

FIELD OF THE INVENTION

The present application is directed to flexible composites exhibiting spike and knife resistant properties.

BACKGROUND

Police, correctional officers, security personnel, and even private individuals have a growing need for simultaneous protection from multiple types of penetration threats, including spike, knife and ballistic threats, in a single protective garment.

Known materials that protect against knife threats typically have flexible metallic plates, metallic chain mails, or laminated, resinated, or coated fabrics. However, the flexible metallic components tend to increase the weight of vests and are difficult to be cut into irregular shapes to fit the body. Further, materials with laminated or resinated or coated fabrics are less satisfactory against knife and spike stab.

Further, merely combining separate materials, each known to protect against one threat, with other material(s) known to protect against other threat(s) does not usually provide a flexible light weight structure comfortable for body wear with adequate protection against multiple threats.

It is an object of this invention to provide a flexible light weight structure that resists penetration by spike and knife threats. It is a further object to provide a flexible light weight structure that resists penetration by ballistic, knives and spike-like threats.

BRIEF SUMMARY OF THE INVENTION

The invention provides a flexible spike and knife resistant composite incorporating a stack of at least ten consolidated layer groupings. Each layer grouping has a normalized stiffness of less than about 5 g/g/m$^2$ as tested by a modified ASTM Test Method D6828-02 and contains one or two spike resistant textile layers, at least one adhesive layer, and one or two knife resistant textile layers. The spike resistant textile layers contain a plurality of interlocked yarns or fibers, where the yarns or fibers have a tenacity of about 8 or more grams per denier and the fiber size is less than ten denier per filament. The knife resistant textile layers contain monoaxially drawn fiber elements, where the fiber elements have an aspect ratio of greater than one and have a size greater than 100 denier per filament. The fiber elements of the knife resistant textile layer are bonded to each other and/or to the spike resistant layer.

The flexible spike and knife resistant composite according to the invention can further comprise ballistic resistant materials and/or additional puncture resistant materials (e.g., chain mail, metal plating, or ceramic plating). The invention also provides a process for producing a flexible spike and knife resistant composite.

BRIEF DESCRIPTION OF THE DRAWINGS

FIGS. 3A, 3B, and 3C illustrate schematically cross-sections of different embodiments of the fiber element being a monoaxially drawn tape element

FIG. 13 is sectional view of a flexible spike and knife resistant composite according to the invention containing a polycarbonate film.

DETAILED DESCRIPTION OF THE INVENTION

The invention is directed to a flexible spike and knife resistant composite. As utilized herein, the term "spike resistant" is generally used to refer to a material that provides protection against penetration of the material by sharp-pointed weapons or objects, such as an ice pick. Thus, a "spike resistant" material can either prevent penetration of the material by such an object or can lessen the degree of penetration of such an object as compared to similar, non-spike resistant materials. As utilized herein, the term "knife resistant" is generally used to refer to a material that provides protection against penetration of the material by edged blades such as knives and other knife-like weapons or objects. Thus, a "knife resistant" material can either prevent penetration of the material by such an object or can lessen the degree of penetration of such an object as compared to similar, non-knife resistant materials.

Preferably, a "spike resistant" material achieves a pass rating when tested against Level 1, Spike class threats in accordance with National Institute of Justice (NIJ) Standard 0115.00 (2000), entitled "Stab Resistance of Personal Body Armor." The term "spike resistant" can also refer to materials (e.g., a composite according to the invention) achieving a pass rating when tested against higher level threats (e.g., Level 2 or Level 3). Preferably, a "knife resistant" material achieves a pass rating when tested against Level 1, edged blade class threats in accordance with National Institute of Justice (NIJ) Standard 0115.00 (2000), entitled "Stab Resistance of Personal Body Armor." The term "knife resistant" can also refer to materials (e.g., a composite according to the invention) achieving a pass rating when tested against higher level threats (e.g., Level 2 or Level 3).

In certain possibly preferred embodiments, the invention can also be directed to spike, knife and ballistic resistant flexible composite. As utilized herein, the term "ballistic resistant" generally refers to a material that is resistant to penetration by ballistic projectiles. Thus, a "ballistic resistant" material can either prevent penetration of the material by a ballistic projectile or can lessen the degree of penetration of such ballistic projectiles as compared to similar, non-ballistic resistant materials. Preferably, a "ballistic resistant" material provides protection equivalent to Type I body armor when such material is tested in accordance with National Institute of Justice (NIJ) Standard 0101.04 (2000), entitled "Ballistic Resistance of Personal Body Armor." The term "ballistic resistant" also refers to a material that achieves a pass rating when tested against Level 1 or higher (e.g., Level 2A, Level 2, Level 3A, or Level 3 or higher) ballistic threats in accordance with NIJ Standard 0101.04.

Figure 1:
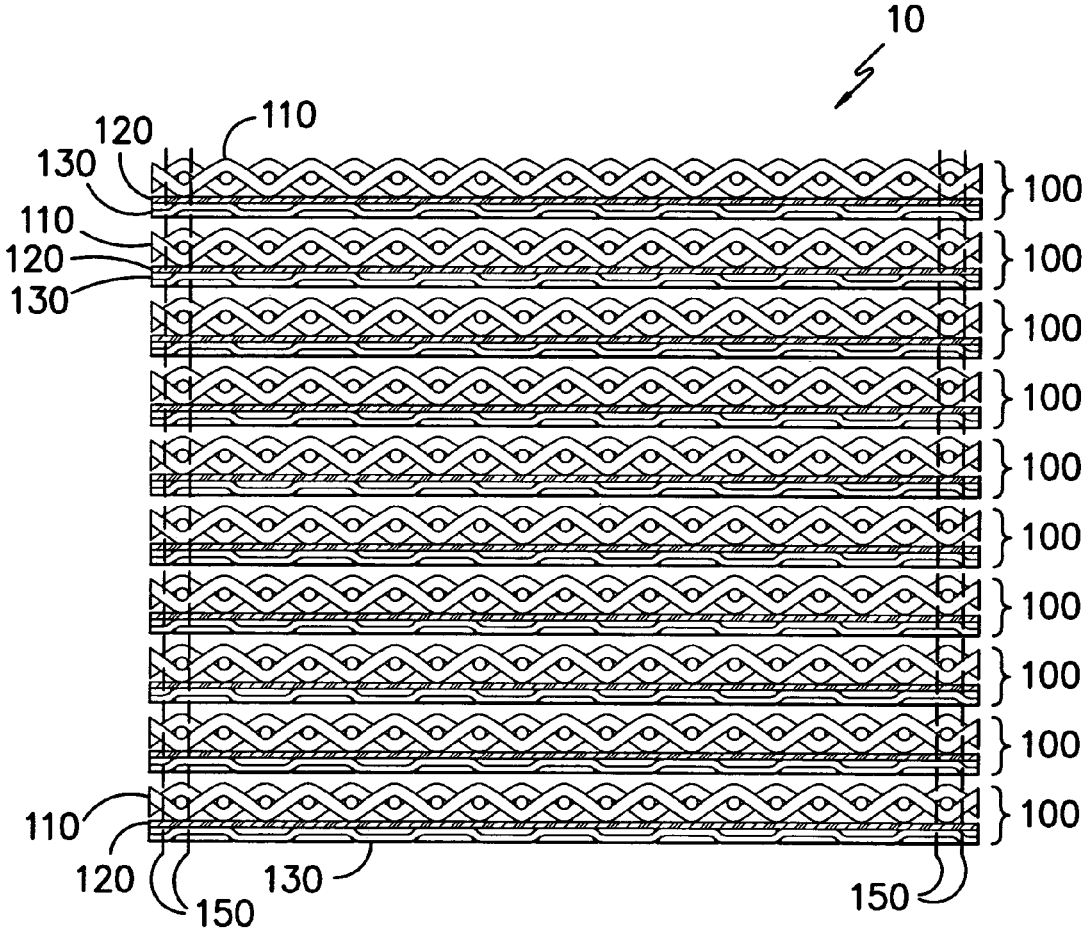
FIG. 1 is a sectional view of a flexible spike and knife resistant composite according to the invention.

The flexible spike and knife resistant composite 10 contains ten consolidated layered groupings 100. Each of these consolidated layered groupings 100 contains one or two spike resistant textile layers 110, at least one adhesive layer 120, and one or two knife resistant textile layers 130. Referring to FIG. 1, there is shown the flexible spike and knife resistant composite 10 having ten consolidated layer groupings 100, each grouping containing one spike resistant layer 110, one adhesive layer 120, and one knife resistant layer 130, where the spike resistant 110 and the knife resistant textile layers 130 form the outer surfaces of the layer grouping 100. The consolidated layer groupings are either loosely stacked or attached by stitching 150 or other attachment means. The layers 110, 120, and 130 of the consolidated layer groupings 100 are consolidated to one another, but the consolidated layer groupings 100 are not consolidated or attached to the adjacent consolidated layer groupings 100. While the flexible composite 10 has been depicted in FIG. 1 as including ten consolidated layer groupings 100, those of ordinary skill in the art will readily appreciate that the flexible composite 10 can comprise any suitable number of consolidated layer groupings 100. For example, the flexible spike and knife resistant composite 10 can comprise ten layer groupings, twelve layer groupings, eighteen layer groupings, twenty layer groupings, thirty layer groupings, or forty layer groupings. While FIG. 1 shows each of the consolidated layer groupings 100 containing the same layers and configuration, the flexible spike and knife resistant composite 10 may contain many different groupings 100 in the composite 10. Preferably, the flexible spike and knife resistant composite 10 has a spike resistance of at least Level1 and a knife resistance of at least Level 1 as tested according to NIJ Standard 0115.00 (2000).

Figure 2:
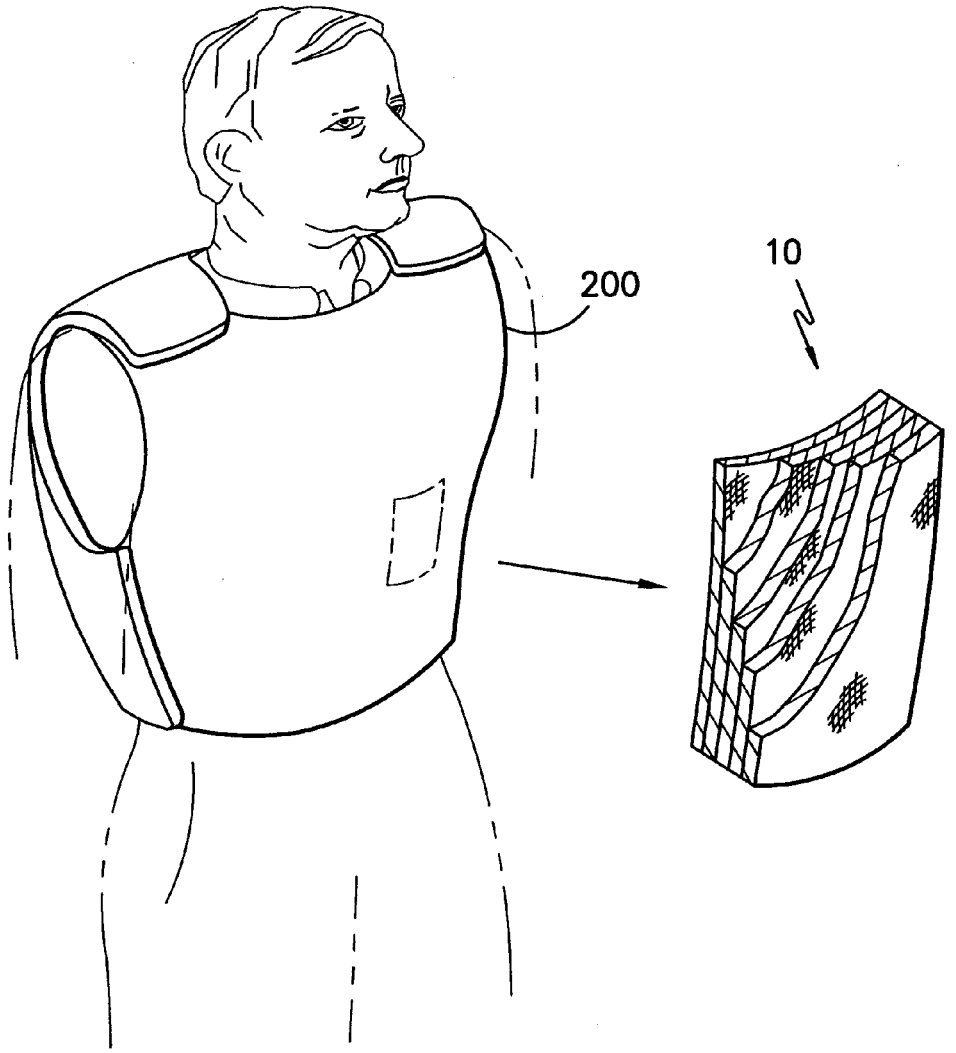
FIG. 2 is a perspective view of a personal protection device, specifically a vest, incorporating the flexible spike and knife resistant composite of the invention.

The flexible spike and knife resistant composite of the invention is particularly well suited for use in personal protection devices, such as personal body armor. For example, as depicted in FIG. 2, the flexible spike and knife resistant composite 10 can be incorporated into a vest 200 in order to provide the wearer protection against spike, knife, and in certain embodiments ballistic threats. The consolidated layer groupings 100 and the flexible spike and knife resistant composite 10 are both able to be bent to a radius of about 4 cm without affecting its physical performance or breaking. Additionally, the consolidated layer grouping 100 have a bending stiffness of between about 10 grams and 1000 grams as tested according to ASTM Test Method D6828-02, entitled "Standard Test Method for Stiffness of Fabric by Blade/Slot Procedure" for a 1 inch wide sample strip and 20 mm wide slot.

Figure 7:
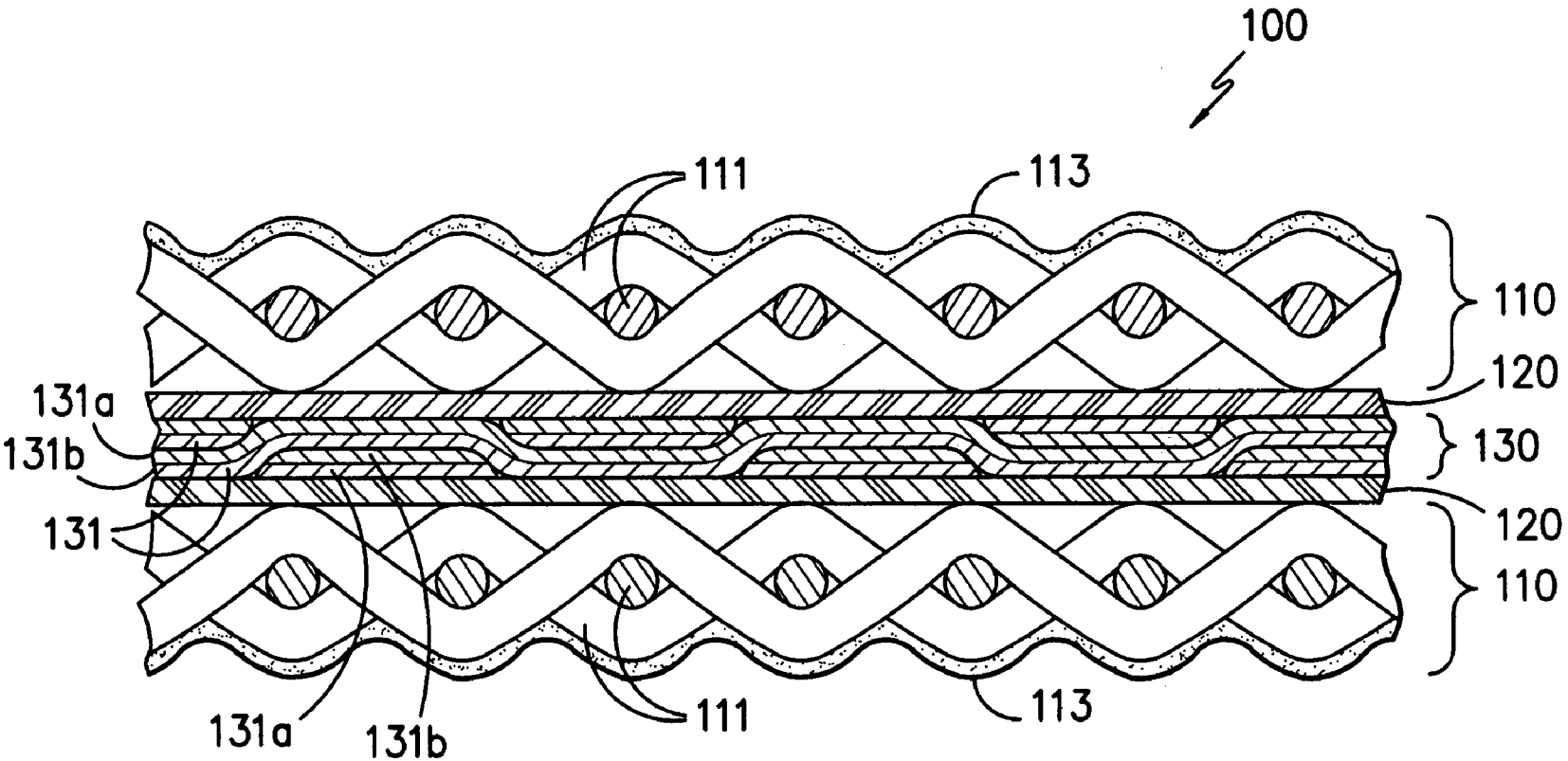
Figure 8:
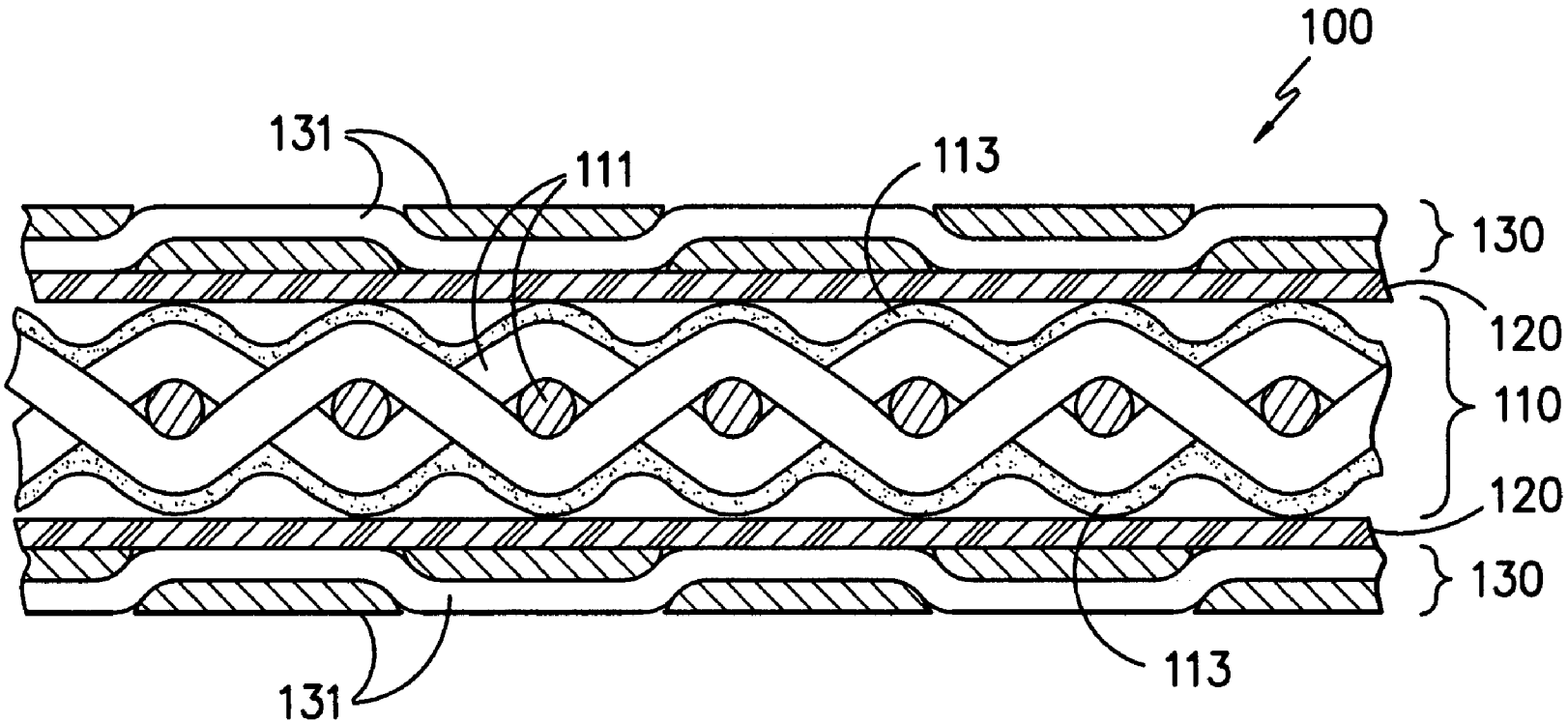
Figure 9:
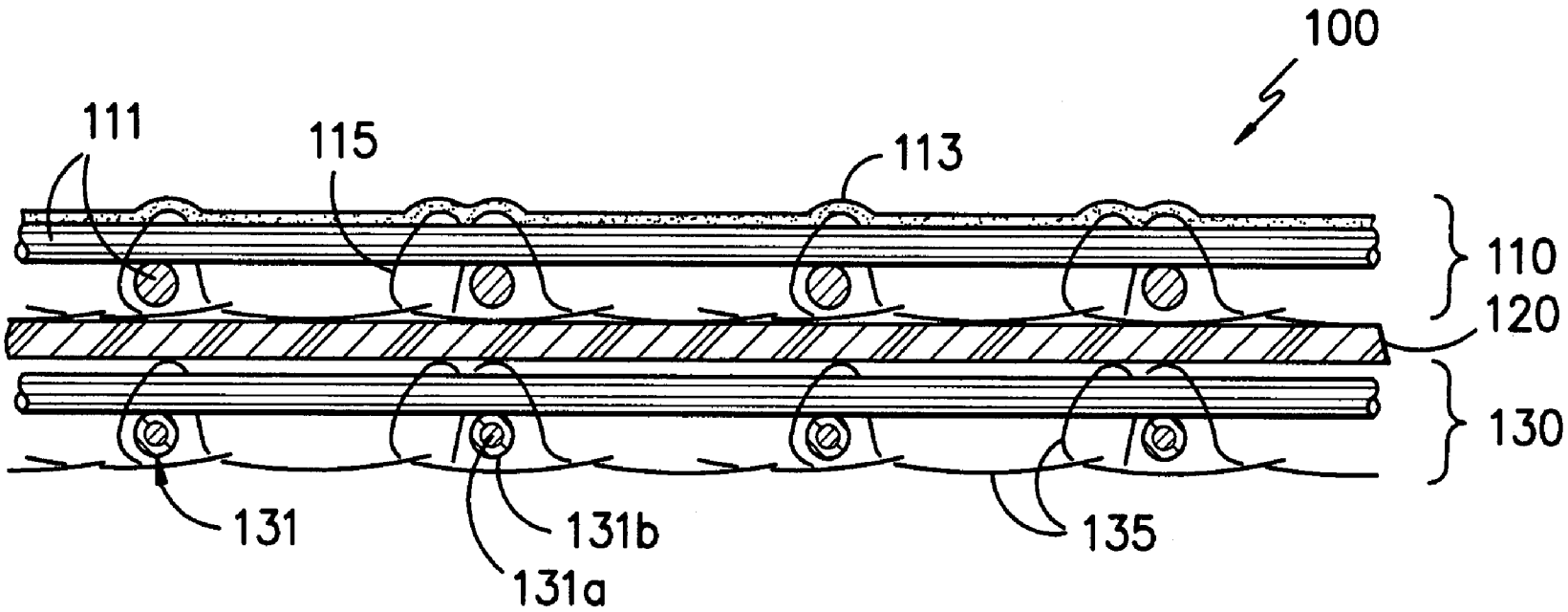

While the spike resistant textile layer 110 is described as being spike resistant, the spike resistant textile layer 110 may also have knife and/or ballistic resistant properties. The spike resistant textile layer 110 contains a plurality of interlocking yarns or fibers 110 having a tenacity of about 8 or more grams per denier. In a preferred embodiment, the plurality of yarns or fibers 110 have a tenacity of about 10 or more grams per denier and have a size of less than ten denier per filament, more preferably less than 5 denier per filament. In another preferred embodiment, the plurality of yarns or fibers 110 has a tenacity of about 15 or more grams per denier. The spike resistant textile layer 110 can have any suitable construction. For example, the spike resistant textile layer 110 can comprise a plurality of yarns provided in a knit or woven construction. The spike layer 110 construction resists slippage of the fibers or yarns past one another. The spike resistant textile layer 110 being a woven layer is shown in FIGS. 1, 5-8, and 10-13 and the spike resistant textile layer 110 being a knit layer is shown in FIG. 9. Alternatively, the spike resistant textile layer 110 can comprise a plurality of fibers provided in a suitable nonwoven construction (e.g., a needle-punched nonwoven, etc).

As will be understood by those of ordinary skill in the art, the spike resistant textile layers 110 in the flexible composite 10 can be independently provided in each of the aforementioned suitable constructions. For example, a spike resistant textile layer 110 can comprise a plurality of yarns 111 provided in a woven construction in one consolidated layer grouping 100, and another spike resistant textile layer 110 can comprise a plurality of fibers 111 provided in a knit construction. In certain possibly preferred embodiments, the spike resistant textile layers 110 comprise a plurality of yarns 111 provided in a woven construction. The spike resistant textile layers 110 can have any suitable weight. In certain possibly preferred embodiments, the spike resistant textile layers 110 can have a weight of about 2 to about 10 ounces per square yard.

The spike resistance layer has a tightness of between greater than about 0.75 as defined in U.S. Pat. Nos. 6,133,169 (Chiou) and 6,103,646 (Chiou), which are incorporated herein by reference. "Fabric tightness factor" and "Cover factor" are names given to the density of the weave of a fabric. Cover factor is a calculated value relating to the geometry of the weave and indicating the percentage of the gross surface area of a fabric that is covered by yarns of the fabric. The equation used to calculate cover factor is as follows (from Weaving: Conversion of Yarns to Fabric, Lord and Mohamed, published by Merrow (1982), pages 141-143):

$d_w$=width of warp yarn in the fabric
$d_f$=width of fill yarn in the fabric
$p_w$=pitch of warp yarns (ends per unit length)
$p_f$=pitch of fill yarns $$C_w = \frac{d_w}{p_w} C_f = \frac{d_f}{p_f}$$

$$\text{Fabric_Cover_Factor} = Cfab = \frac{\text{total_area_obsured}}{\text{area_enclosed}}$$

$$C_{fab} = \frac{(p_w - d_w)d_f + d_w p_f}{p_w p_f}$$

$$C_{fab} = (C_f + C_w - C_f C_w)$$

Depending on the kind of weave of a fabric, the maximum cover factor may be quite low even though the yarns of the fabric are situated close together. For that reason, a more useful indicator of weave tightness is called the "fabric tightness factor". The fabric tightness factor is a measure of the tightness of a fabric weave compared with the maximum weave tightness as a function of the cover factor.

$$\text{Fabric_tightness_factor} = \frac{\text{actual_cover_factor}}{\text{maximum_cover_factor}}$$

For example, the maximum cover factor that is possible for a plain weave fabric is 0.75; and a plain weave fabric with an actual cover factor of 0.68 will, therefore, have a fabric tightness factor of 0.91. The preferred weave for practice of this invention is plain weave.

The yarns or fibers 111 of the spike resistant textile layers 110 can comprise any suitable fibers. Yarns or fibers 111 suitable for use in the spike resistant textile layer 110 generally include, but are not limited to, high tenacity and high modulus yarns or fibers, which refers to yarns that exhibit a relatively high ratio of stress to strain when placed under tension. In order to provide adequate protection against ballistic projectiles, the yarns or fibers of the spike resistant textile layers 110 typically have a tenacity of about 8 or more grams per denier. In certain possibly preferred embodiments, the yarns or fibers of the spike resistant textile layers 110 can have a tenacity of about 10 or more grams per denier, more preferably 15 or more grams per denier.

Fibers or yarns 111 suitable for use in the spike resistant textile layers 110 include, but are not limited to, fibers made from highly oriented polymers, such as gel-spun ultrahigh molecular weight polyethylene fibers (e.g., SPECTRA® fibers from Honeywell Advanced Fibers of Morristown, N.J. and DYNEEMA® fibers from DSM High Performance Fibers Co. of the Netherlands), melt-spun polyethylene fibers (e.g., CERTRAN® fibers from Celanese Fibers of Charlotte, N.C.), melt-spun nylon fibers (e.g., high tenacity type nylon 6,6 fibers from Invista of Wichita, Kans.), melt-spun polyester fibers (e.g., high tenacity type polyethylene terephthalate fibers from Invista of Wichita, Kans.), and sintered polyethylene fibers (e.g., TENSYLON® fibers from ITS of Charlotte, N.C.). Suitable fibers also include those made from rigid-rod polymers, such as lyotropic rigid-rod polymers, heterocyclic rigid-rod polymers, and thermotropic liquid-crystalline polymers. Suitable fibers made from lyotropic rigid-rod polymers include aramid fibers, such as poly(p-phenyleneterephthalamide) fibers (e.g., KEVLAR® fibers from DuPont of Wilmington, Del. and TWARON® fibers from Teijin of Japan) and fibers made from a 1:1 copolyterephthalamide of 3,4'-diaminodiphenylether and p-phenylenediamine (e.g., TECHNORA® fibers from Teijin of Japan). Suitable fibers made from heterocyclic rigid-rod polymers, such as p-phenylene heterocyclics, include poly(p-phenylene-2,6-benzobisoxazole) fibers (PBO fibers) (e.g., ZYLON® fibers from Toyobo of Japan), poly(p-phenylene-2,6-benzobisthiazole) fibers (PBZT fibers), and poly[2,6-diimidazo[4,5-b:4',5'-e]pyridinylene-1,4-(2,5-dihydroxy)phenylene] fibers (PIPD fibers) (e.g., M5® fibers from DuPont of Wilmington, Del.). Suitable fibers made from thermotropic liquid-crystalline polymers include poly(6-hydroxy-2-napthoic acid-co-4-hydroxybenzoic acid) fibers (e.g., VECTRAN® fibers from Celanese of Charlotte, N.C.). Suitable fibers also include carbon fibers, such as those made from the high temperature pyrolysis of rayon, polyacrylonitrile (e.g., OPF® fibers from Dow of Midland, Mich.), and mesomorphic hydrocarbon tar (e.g., THORNEL® fibers from Cytec of Greenville, S.C.). In certain possibly preferred embodiments, the yarns or fibers 111 of the spike resistant textile layers 110 comprise fibers selected from the group consisting of gel-spun ultrahigh molecular weight polyethylene fibers, melt-spun polyethylene fibers, melt-spun nylon fibers, melt-spun polyester fibers, sintered polyethylene fibers, aramid fibers, PBO fibers, PBZT fibers, PIPD fibers, poly(6-hydroxy-2-napthoic acid-co-4-hydroxybenzoic acid) fibers, carbon fibers, and combinations thereof. In one particularly preferred embodiment, the spike resistant textile layer 110 comprises woven aramid fibers 111.

Figure 5:
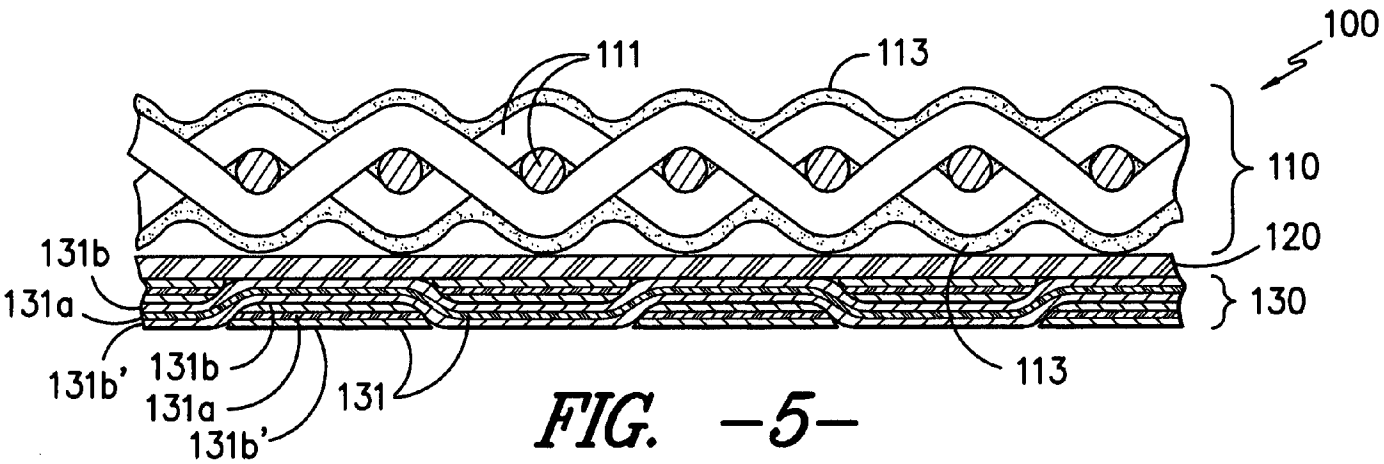
FIGS. 5-11 are sectional views of different configurations of consolidated layer groupings according to the invention.
Figure 6:
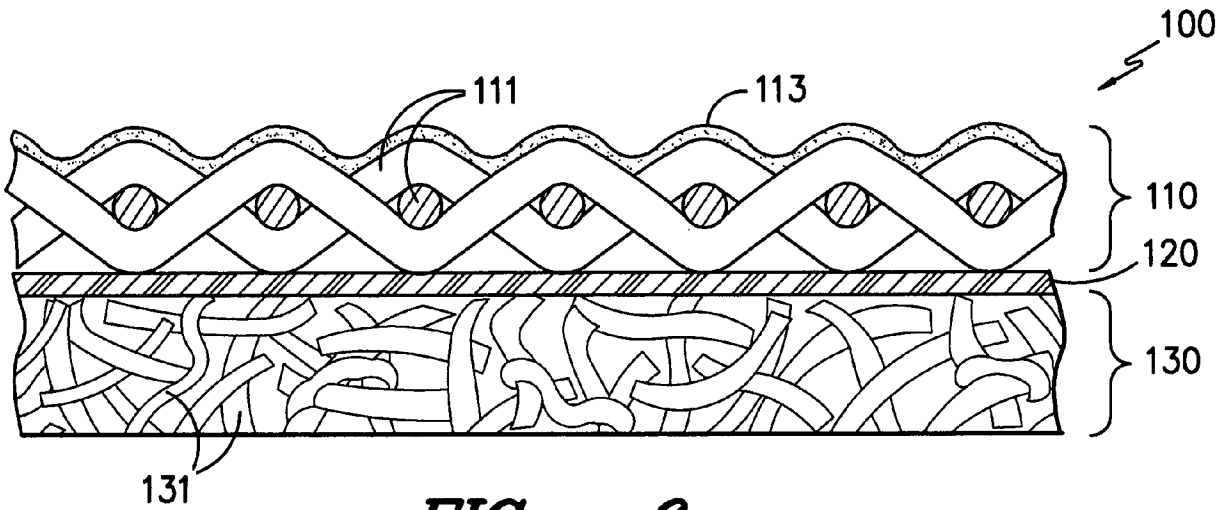

In one embodiment, the spike resistant textile layer 110 comprises a coating 113 on at least a surface thereof. In certain possibly preferred embodiments, the coating can penetrate into the interior portion of the textile layer 110 to at least partially coat the yarns or fibers 111 of the spike resistant textile layer 110. FIG. 5 shows the coating 113 on both sides and in the interior of the fibers 111. In another embodiment, the coating 113 is applied to either surface of the spike resistant textile layer 110. The coating 113 may be applied to the surfaces of the spike resistant textile layers 110 which are not adjacent to a surface of another layer as shown in FIGS. 6 and 7 or may be applied such that the coating 113 lies between two adjacent layers as in FIG. 5.

The coating 113 applied to the spike resistant textile layers 110 comprises particulate matter (e.g., a plurality of particles). The particles included in the coating 113 can be any suitable particles, but preferably are particles having a diameter of about 20 μm or less, or about 10 μm or less, or about 1 μm or less (e.g., about 500 nm or less or about 300 nm or less). Particles suitable for use in the coating include, but are not limited to, silica particles, (e.g., fumed silica particles, precipitated silica particles, alumina-modified colloidal silica particles, etc.), alumina particles (e.g. fumed alumina particles), and combinations thereof. In certain possibly preferred embodiments, the particles are comprised of at least one material selected from the group consisting of fumed silica, precipitated silica, fumed alumina, alumina modified silica, zirconia, titania, silicon carbide, titanium carbide, tungsten carbide, titanium nitride, silicon nitride, and the like, and combinations thereof. Such particles can also be surface modified, for instance by grafting, to change surface properties such as charge and hydrophobicity. Suitable commercially available particles include, but are not limited to, the following: CAB-O-SPERSE® PG003 fumed alumina, which is a 40% by weight solids aqueous dispersion of fumed alumina available commercially from Cabot Corporation of Boyertown, Pa. (the dispersion has a pH of 4.2 and a median average aggregate particle size of about 150 nm); SPECTRAL™ 51 fumed alumina, which is a fumed alumina powder available commercially from Cabot Corporation of Boyertown, Pa. (the powder has a BET surface area of 55 $m^2/g$ and a median average aggregate particle size of about 150 nm); CAB-O-SPERSE® PG008 fumed alumina, which is a 40% by weight solids aqueous dispersion of fumed alumina available commercially from Cabot Corporation of Boyertown, Pa. (the dispersion has a pH of 4.2 and a median average aggregate particle size of about 130 nm); SPECTRAL™ 81 fumed alumina, which is a fumed alumina powder available commercially from Cabot Corporation of Boyertown, Pa. (the powder has a BET surface area of 80 $m^2/g$ and a median average aggregate particle size of about 130 nm); AEROXIDE ALU C fumed alumina, which is a fumed alumina powder available commercially from Degussa, Germany (the powder has a BET surface area of 100 $m^2/g$ and a median average primary particle size of about 13 nm); LUDOX® CL-P colloidal alumina coated silica, which is a 40% by weight solids aqueous sol available from Grace Davison (the sol has a pH of 4 and an average particle size of 22 nm in diameter); NALCO® 1056 aluminized silica, which is a 30% by weight solids aqueous colloidal suspension of aluminized silica particles (26% silica and 4% alumina) available commercially from Nalco; LUDOX® TMA colloidal silica, which is a 34% by weight solids aqueous colloidal silica sol available from Grace Davison. (the sol has a pH of 4.7 and an average particle size of 22 nm in diameter); NALCO® 88SN-126 colloidal titanium dioxide, which is a 10% by weight solids aqueous dispersion of titanium dioxide available commercially from Nalco; CAB-O-SPERSE® S3295 fumed silica, which is a 15% by weight solids aqueous dispersion of fumed silica available commercially from Cabot Corporation of Boyertown, Pa. (the dispersion has a pH of 9.5 and an average agglomerated primary particle size of about 100 nm in diameter); CAB-O-SPERSE® 2012A fumed silica, which is a 12% by weight solids aqueous dispersion of fumed silica available commercially from Cabot Corporation of Boyertown, Pa. (the dispersion has a pH of 5); CAB-O-SPERSE® PG001 fumed silica, which is a 30% by weight solids aqueous dispersion of fumed silica available commercially from Cabot Corporation of Boyertown, Pa. (the dispersion has a pH of 10.2 and a median aggregate particle size of about 180 nm in diameter); CAB-O-SPERSE® PG002 fumed silica, which is a 20% by weight solids aqueous dispersion of fumed silica available commercially from Cabot Corporation of Boyertown, Pa. (the dispersion has a pH of 9.2 and a median aggregate particle size of about 150 nm in diameter); CAB-O-SPERSE® PG022 fumed silica, which is a 20% by weight solids aqueous dispersion of fumed silica available commercially from Cabot Corporation of Boyertown, Pa. (the dispersion has a pH of 3.8 and a median aggregate particle size of about 150 nm in diameter); SIPERNAT® 22LS precipitated silica, which is a precipitated silica powder available from Degussa of Germany (the powder has a BET surface area of 175 $m^2/g$ and a median average primary particle size of about 3 μm); SIPERNAT® 500LS precipitated silica, which is a precipitated silica powder available from Degussa of Germany (the powder has a BET surface area of 450 $m^2/g$ and a median average primary particle size of about 4.5 μm); and VP Zirconium Oxide fumed zirconia, which is a fumed zirconia powder available from Degussa of Germany (the powder has a BET surface area of 60 $m^2/g$).

In certain possibly preferred embodiments, the particles can have a positive surface charge when suspended in an aqueous medium, such as an aqueous medium having a pH of about 4 to 8. Particles suitable for use in this embodiment include, but are not limited to, alumina-modified colloidal silica particles, alumina particles (e.g. fumed alumina particles), and combinations thereof. In certain possibly preferred embodiments, the particles can have a Mohs' hardness of about 5 or more, or about 6 or more, or about 7 or more. Particles suitable for use in this embodiment include, but are not limited to, fumed alumina particles. In certain possibly preferred embodiments, the particles can have a three-dimensional branched or chain-like structure comprising or consisting of aggregates of primary particles. Particles suitable for use in this embodiment include, but are not limited to, fumed alumina particles, fumed silica particles, and combinations thereof.

The particles included in the coating can be modified to impart or increase the hydrophobicity of the particles. For example, in those embodiments comprising fumed silica particles, the fumed silica particles can be treated, for example, with an organosilane in order to render the fumed silica particles hydrophobic. Suitable commercially-available hydrophobic particles include, but are not limited to, the R-series of AEROSIL® fumed silicas available from Degussa, such as AEROSIL® R812, AEROSIL® R816, AEROSIL® R972, and AEROSIL® R7200. While not wishing to be bound to any particular theory, it is believed that using hydrophobic particles in the coating will minimize the amount of water that the composite will absorb when exposed to a wet environment. When hydrophobic particles are utilized in the coating on the textile layer(s) 110, the hydrophobic particles can be applied using a solvent-containing coating composition in order to assist their application. Such particles and coatings are believed to be more fully described in U.S. Patent Publication No. 2007/0105471 (Wang et al.), incorporated herein by reference.

The spike resistant textile layer(s) 110 can comprise any suitable amount of the coating 113. As will be understood by those of ordinary skill in the art, the amount of coating applied to the spike resistant textile layer(s) 110 generally should not be so high that the weight of the composite 10 is dramatically increased, which could potentially impair certain end uses for the composite 10. Typically, the amount of coating 113 applied to the spike resistant textile layer(s) 110 will comprise about 10 wt. % or less of the total weight of the textile layer 110. In certain possibly preferred embodiments, the amount of coating applied to the spike resistant textile layer(s) 110 will comprise about 5 wt. % or less or about 3 wt. % or less (e.g., about 2 wt. % or less) of the total weight of the textile layer 110. Typically, the amount of coating applied to the spike resistant textile layer(s) 110 will comprise about 0.1 wt. % or more (e.g., about 0.5 wt. % or more) of the total weight of the textile layer 110. In certain possibly preferred embodiments, the coating comprises about 2 to about 4 wt. % of the total weight of the textile layer 110.

In certain possibly preferred embodiments of the flexible spike and knife resistant composite 10, the coating 113 applied to the spike resistant textile layer 110 can further comprise a binder. The binder included in the coating 113 can be any suitable binder. Suitable binders include, but are not limited to, isocyanate binders (e.g., blocked isocyanate binders), acrylic binders (e.g, nonionic acrylic binders), polyurethane binders (e.g., aliphatic polyurethane binders and polyether based polyurethane binders), epoxy binders, and combinations thereof. In certain possibly preferred embodiments, the binder is a cross-linking binder, such as a blocked isocyanate binder.

When present, the binder can comprise any suitable amount of the coating applied to the spike resistant textile layer(s) 110. The ratio of the amount (e.g., weight) of particles present in the coating to the amount (e.g., weight) of binder solids present in the coating 113 typically is greater than about 1:1 (weight particles:weight binder solids). In certain possibly preferred embodiments, the ratio of the amount (e.g., weight) of particles present in the coating 113 to the amount (e.g., weight) of binder solids present in the coating typically is greater than about 2:1, or greater than about 3:1, or greater than about 4:1, or greater than about 5:1 (e.g., greater than about 6:1, greater than about 7:1, or greater than about 8:1). It is noted that when the coating 113 is applied to the spike resistant layer, the spike layer can have a much lower fabric tightness fabric to achieve the same level of spike resistance.

In certain possibly preferred embodiments, the coating 113 applied to the spike resistant textile layer(s) 110 can comprise a water-repellant in order to impart greater water repellency to the composite 10. The water-repellant included in the coating can be any suitable water-repellant including, but not limited to, fluorochemicals or fluoropolymers.

Referring back to FIG. 1 to the consolidated layer groupings 100, there is shown an adhesive layer 120 in contacting relationship with the spike resistant textile layer 110 and the knife resistant textile layer 130. The adhesive layer 120 may melt, conform, penetrate the other layers, or otherwise change shape during the application of the adhesive layer and consolidation of the layered grouping 100, but is shown as a distinct layer for ease of viewing in the Figures. In one embodiment, the adhesive layer 120 has a lower melting temperature than the base layer of the fiber elements. The adhesive layer 120 adheres the textile layers (spike to spike, spike to knife, knife to knife) together during consolidation. The adhesive layer 120 preferably comprises a material which is compatible with the adjacent textile layers 110, 130 and fuses the textile layers 110, 130 into a consolidated layer grouping 100. The adhesive layer may be activated to fuse together the layered grouping 100 by pressure, heat, UV, other activation methods, or any combination thereof. In one embodiment, the adhesive layer 120 is a pressure sensitive adhesive. In another embodiment, the adhesive layer is a thermoplastic having a softening point less than that of the covering layer of the fiber elements 131 of the knife resistant textile layer 130. Preferably, the softening point of the adhesive is at least 10° C. less than that of the covering layer of the fiber elements 131. In one embodiment, a melting point of less than 130° C. of the adhesive layer 120 is preferred. The adhesive layer 120 may be, but is not limited to EVA, LLDPE, LDPE, HDPE, copolymers of polypropylene, and the like. Preferably, the adhesive layer 120 forms an inner layer of the consolidated layer grouping 100, meaning that the adhesive layer 120 does not lie on an outer surface of the consolidated layer grouping 100.

The adhesive layer may be formed by any method known in the art. Preferred methods include any well known coating method such as air knife coating, gravure coating, hopper coating, roller coating, spray coating, gravure printing, inkjet printing, thermal transfer, and the like. The adhesive layer 120 may be a continuous or discontinuous layer, having a pattern or being random. The coating composition can be based on water or organic solvent(s) or a mixture of water and organic solvent(s). Alternatively, the adhesive layer 120 can be formed by thermal processing such as extrusion and co-extrusion with and without stretching, blow molding, injection molding, lamination, etc. The adhesive layer 120 may also be an adhesive film, web, scrim, powder coating, or the like.

Figure 4A:
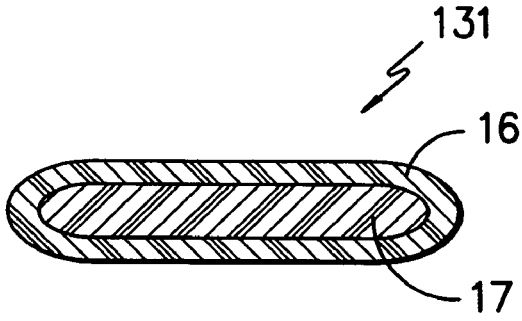
FIGS. 4A, 4B and 4C illustrate schematically cross-sections of different embodiments of the fiber element.
Figure 4B:
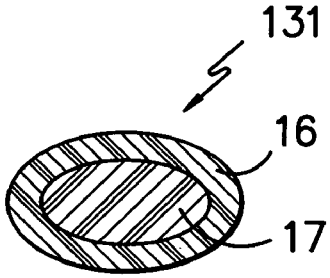

While the knife resistant textile layer 130 is described as being knife resistant, the textile layer 130 may also have spike and/or ballistic resistant properties also. The knife resistant textile layer 130 contains monoaxially drawn fiber elements 131. The fiber elements have an aspect ratio of greater than 1, more preferably greater than 10, and have a size greater than 100 denier pre filament. In another embodiment, the fiber elements 131 comprise a base layer 131*a* and at least one covering layer 131*b* (131*b*') of a heat fusible polymer, the covering layer 131*b* being characterized by a softening temperature below that of the base layer 131*a* to permit fusion bonding upon application of heat. FIGS. 3A-B show embodiments of the fiber element 131 being a tape element having a base layer 131*a* and at least one covering layer 131*b*. FIGS. 4A-B show embodiments of the fiber element 131 being a core/shell fiber element having a base layer 131*a* and at least one covering layer 131*b*. In another embodiment, the fiber elements 131 are a monolayer as shown in FIG. 3C as a monolayer tape element and in FIG. 4C as a monolayer fiber element with an oblong construction. Preferably, the tape elements 131 have a width of between about 0.1 and 20 mm, more preferably between about 0.5 and 5.0 mm.

Figure 11:
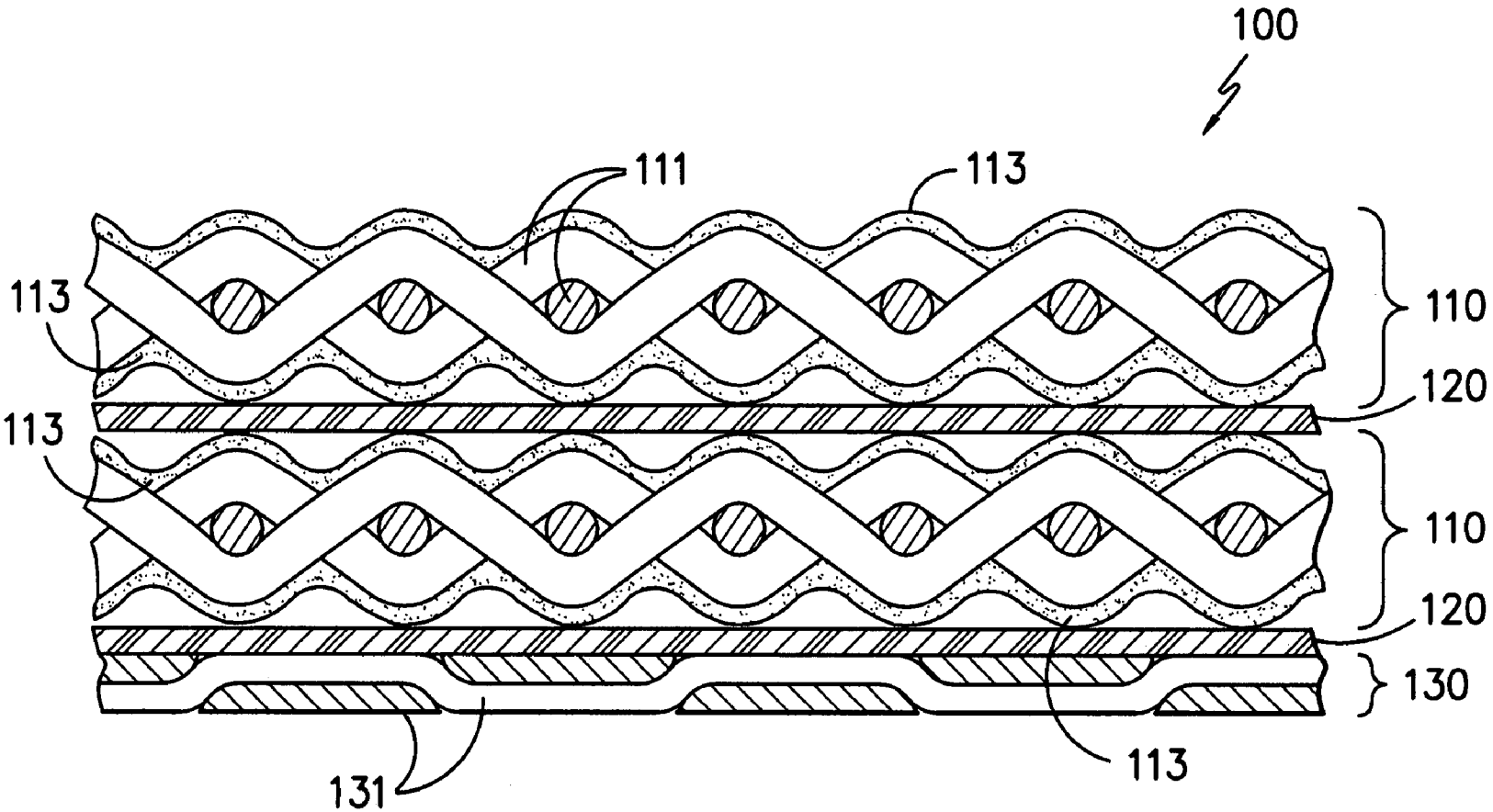

In one embodiment shown in FIG. 3A, the monoaxially drawn fiber element 131 is a tape element made up of at least one covering layer 131*b* disposed on a base layer 131*a*. The covering layer 131*b* covers one side (upper or lower surface) of the base layer 131*a*. FIG. 7 shows a knife resistant textile layer 130 made of tape elements having a base layer 131*a* and one covering layer 131*b*. Referring to FIG. 3B, there is shown another embodiment of the fiber elements 131 being tape elements made up of a base layer 131*a* disposed between two covering layers 131*b* and 131*b*' (the covering layers being disposed on the upper and lower surface of the base layer 131*a*). The fiber element 131 being a tape element may be formed by any conventional means of extruding multilayer polymeric films and then slitting the films into fiber elements 131. FIG. 5 shows a knife resistant textile layer 130 made of tape elements having a base layer 131*a* and two covering layers 131*b* and 131*b*'. FIGS. 8 and 11 illustrate the knife resistant textile layer 130 made up of monolayer tape elements 131. In the case where the fiber elements do not have a covering layer, once consolidated into a consolidated layer grouping 100, the fiber elements 131 may be adhered to the spike layer 110 through the adhesive layer 120 with some, little, or no adhesion to the other fiber elements 131 in the knife resistant textile layer 130.

By way of example, and not limitation, the film from which the fiber elements 131 being tape elements are formed may be formed by blown film or cast film extrusion or co-extrusion. The film is then cut into a multiplicity of longitudinal strips of a desired width by slitting the film in a direction transverse to the layered orientation of base layer 131*a* and covering layer(s) 131*b* to form fiber elements 131 being tape elements with cross-sections as shown in FIGS. 3A and 3B. The fiber elements 131 are then drawn in order to increase the orientation of the base layer 131*a* so as to provide increased strength and stiffness of the material. In another embodiment, the covering layer(s) 131*b* (131*b*') may be added after the drawing step in any suitable technique known in the art including coating, spraying, and printing. After the drawing process is complete, the resulting fiber elements being tape elements are in the range of about 1.0 to about 5 millimeters wide. In one embodiment, the fiber elements 131 have a width to thickness ratio of between about 10 and 1000. The tape elements 131 having one base layer 131*a* and two covering layers 131*b* and 131*b*' are shown in FIG. 5. The tape elements 131 which have one base layer 131*a* and one covering layer 131*b* are shown in FIG. 7. Additional Figures show the tape elements 131 without the subcomponents for simplicity, but each of the tape elements have no covering layers, one covering layer, or two covering layers.

Figure 4C:
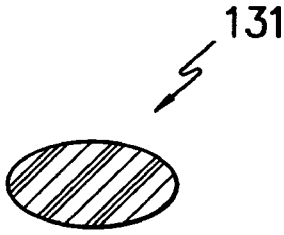

Referring now to FIGS. to 4A and 4B, there is shown some embodiments of a fiber element 131 being a core/shell type fiber element made up of a covering layer 131*b* disposed on a base layer 131*a* covering at least a portion of the base layer 131*a*. Preferably, the covering layer 131*b* covers the base layer 131*a* surface area completely. The base layer 131*a* is typically a fiber with a circular, oblong, elliptical, elongated or other cross-section. In one embodiment, the cross-section of the base layer 131*a* has a major to minor axis aspect ratio of between 1 and 30. The base layer 131*a* and covering layer 131*b* may be co-extruded together, or the covering layer 131*b* may be applied to the base layer 131*a* after the base layer 131*a* has been formed. The fiber element 131 is oriented before or after the covering layer 131*b* is formed in order to increase the orientation of the base layer 131*a* so as to provide increased strength and stiffness. FIG. 4C illustrates another embodiment where the fiber elements 131 are monolayer without any covering layers. FIG. 9 illustrates a knife resistant textile layer made up of fibers 131 having a base layer 131*a* and a covering layer 131*b* in a knit construction. While different Figures have different configurations of the fiber elements, it is understood that the different configuration of fiber elements (being fibers, tapes with or without covering layers, core/Shell fibers) may be used interchangeably.

The base layer 131*a* of the fiber elements 131 is preferably made up of a molecularly-oriented thermoplastic polymer, the base layer 131*a* being fusible and compatibly bonded to each of covering layers 131*b*, 131*b*' at their respective intersections and contiguous surfaces. It is further contemplated that the covering layer(s) 131*b*, 131*b*' have a softening temperature, or melting temperature, lower than that of the base layer 131*a*. By way of example only, it is contemplated that the base layer 131*a* is a polyolefin polymer such as polypropylene or polyethylene, polyester such as polyethylene terephthalate, or polyamide such as Nylon 6 or Nylon 6,6 (polyester and polyurethane are common base layer materials with low-melt polyester, polypropylene or polyethylene shells). Core-wrap yarns are also common materials and include elastomeric yarns wrapped with fibers of other materials to impart different aesthetics, hand, color, UV resistance, etc. The preferred covering layer 131*b* materials for this invention are polyolefin in nature where a highly drawn and therefore highly oriented polypropylene or polyethylene has a lower softening point polyolefin covering layer(s) commonly comprised of homopolymers or copolymers of ethylene, propylene, butene, 4-methyl-1-pentene, and/or like monomers. According to one potentially preferred practice, the base layer 131*a* may be polypropylene or polyethylene. The base layer 131*a* may account for about 50-99 wt. % of the tape or fiber element, while the covering layer(s) 131*b*, 131*b*' account for about 1-50 wt. % of the tape or fiber element 131. The base layer 131*a* and covering layer(s) 131*b*, 131*b*' being made up of the same class of materials to provide an advantage with regard to recycling, as the base layer 131*a* may include production scrap.

In an embodiment where the base layer 131*a* is polypropylene, the material of covering layer(s) 131*b*, and 131*b*' is preferably a copolymer of propylene and ethylene or an α-olefin. In one embodiment, the covering layer(s) 131*b*, 131*b*' comprise a random copolymer of propylene-ethylene with an ethylene content of about 1-25 mol. %, and a propylene content of about 75-99 mol. %. It may be further preferred to use said copolymer with a ratio of about 95 mol. % propylene to about 5 mol. % ethylene. Instead of said copolymer or in combination therewith, a polyolefin, preferably a polypropylene homopolymer or polypropylene copolymer, prepared with a metallocene catalyst, may be used for the covering layer(s) 131*b*, 131*b*'. It is also contemplated that materials such as poly(4-methyl-1-pentene) (PMP) and polyethylene may be useful as a blend with such copolymers in the covering layer(s) 131*b*, 131*b*'. The covering layer material should be selected such that the softening point of the covering layer(s) 131*b*, 131*b*' is at least about 10° C. lower than that of the base layer 131*a*, and preferably between about 15-40° C. lower. The upper limit of this difference is not thought to be critical, and the difference in softening points is typically less than 70° C. Softening point, for this application, is defined as the Vicat softening temperature (ASTM D1525). It is desirable to minimize the amount of adhesive used to maximize the amount of fiber elements in a composite.

Figure 10:
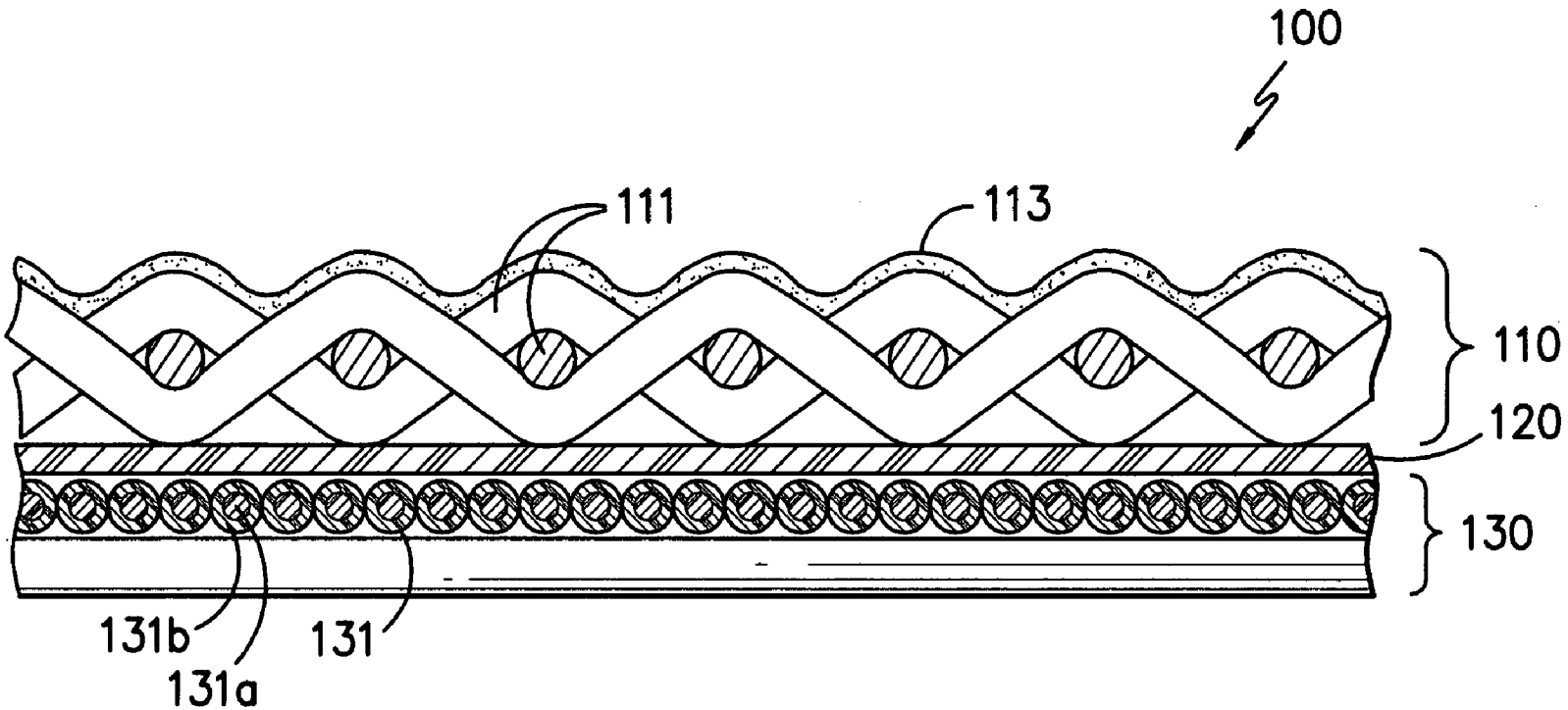

The knife resistant textile layer 130 can have any suitable construction. For example, the knife resistant textile layer 130 can comprise a fiber elements 131 provided in a knit or woven construction. Alternatively, the knife resistant textile layer 130 can comprise a plurality of fiber elements 131 provided in a suitable nonwoven construction such as a needle-punched nonwoven, an air-laid nonwoven, a unidirectional layer etc. One knife resistant textile layer 130 is defined to have a set of fiber elements in one direction and a set of fiber elements in approximately perpendicular arrangement to the first set. One layer of woven or knit fabric satisfies this definition. For a unidirectional layer as shown in FIG. 10, a set of fibers in the two perpendicular directions is defined as one layer. For a nonwoven layer, the layer contains fiber elements at random angles to one another.

As will be understood by those of ordinary skill in the art, the knife resistant textile layers 130 in the flexible composite 10 can be independently provided in each of the aforementioned suitable constructions. For example, in the composite 10 embodiment containing consolidated layer groupings 100 a knife resistant textile layer 130 can comprise a plurality of fiber elements 131 provided in a woven construction 100 in one layer grouping 100, and another knife resistant textile layer 130 can comprise a plurality of fiber elements 131 provided in a knit construction in another consolidated layer grouping 100. In another example where the composite contains loose layers and no consolidated groupings, the composite may contain at least one knife resistant textile layer 130 having a plurality of fiber elements 131 provided in a woven construction and at least one knife resistant textile layer 130 having a plurality of fiber elements 131 provided in a knit construction, and optionally at least one knife resistant textile layer 130 having a plurality of fiber elements 131 provided in a nonwoven construction. The knife resistant textile layer 130 is shown as a woven layer in FIGS. 1, 5, 7, 8, and 11-13, as a nonwoven with random fibers elements in FIG. 6, a unidirectional layer(s) in FIG. 10, and a knit layer in FIG. 9.

For the embodiment where the knife resistant textile layers 130 are in a woven construction, the woven layer preferably includes a multiplicity of warp and weft elements interwoven together such that a given weft element extends in a predefined crossing pattern above and below the warp element. In the illustrated arrangement, the warp and weft elements are formed into a so called plain weave wherein each weft element passes over a warp element and thereafter passes under the adjacent warp element in a repeating manner across the full width of the textile layer 130. However, it is also contemplated that any number of other weave constructions as will be well known to those of skill in the art may likewise be utilized. Thus, the terms "woven" and "interwoven" are meant to include any construction incorporating interengaging formation fiber elements 131.

Alternatively, as shown in FIG. 10, there is shown the knife resistant textile layer 130 being a unidirectional sheet formed from a multiplicity of fiber elements 131 are aligned parallel along a common fiber direction. In one embodiment, the fiber elements 131 in the textile layer 130 do not overlap one another, and may have gaps between the fiber elements 131. In another embodiment, the fiber elements overlap one another up to 90% in the textile layer 130. Fiber elements being tape elements, core-shell elements, and their textile layer constructions are believed to be more fully described in U.S. Patent Publication No. 2007/0071960 (Eleazer et al.), U.S. patent application Ser. No. 11/519,134 (Eleazer et al.), and U.S. Pat. Nos. 7,300,691 (Eleazer et al.), 7,294,383 (Eleazer et al.), and 7,294,384 (Eleazer et al.), each of which is incorporated by reference.

FIG. 1 illustrates one embodiment of the arrangement of the layers within the consolidated layer groupings. FIGS. 5-11 illustrate additional consolidated layer groups 100. These may be mixed and matched in the flexible composite 10 according to the desired properties and end use. The groupings may be oriented such that either surface may face the user or face outward. FIGS. 5 and 7 show details of the base layer 131 and covering layers 131*b*, 131*b*'. The other Figures do not include these details for ease of viewing the figures, but the tape elements 131 in those Figures may be formed according to FIG. 5 or 7 or may be monolayer tape elements.

FIG. 5 shows a close up illustration of the consolidated layer group 100 of FIG. 1 having one woven spike resistant textile layer 110, one adhesive layer 120 and one woven knife resistant textile layer 130, where the spike resistant 110 and the knife resistant textile layers 130 form the outer surfaces of the layer grouping.

FIG. 6 shows a close up illustration of the consolidated layer group 100 having one woven spike resistant textile layer 110, one adhesive layer 120 and one nonwoven knife resistant textile layer 130. The nonwoven knife resistant textile layer 130 is a layer of random staple length fiber elements 131 being tape elements.

FIG. 7 is an illustration of the consolidated layer group 100 having two woven spike resistant textile layers 110, one adhesive layer 120 and one woven knife resistant textile layer 130. The spike resistant textile layers 110 form the outer surfaces of the layer grouping.

FIG. 8 is an illustration of the consolidated layer group 100 having one woven spike resistant textile layer 110, one adhesive layer 120 and two woven knife resistant textile layers 130. The knife resistant textile layers 130 form the outer surfaces of the layer grouping.

FIG. 9 is an illustration of the consolidated layer group 100 having one knit spike resistant textile layer 110, one adhesive layer 120 and one knit knife resistant textile layer 130. The knit knife resistant textile layer 130 contains fiber elements 131 being a core/shell type fiber have a base layer 131*a* and a covering layer 131*b*. The spike resistant textile layer 110 and the knife resistant textile layer 130 form the outer surfaces of the layer grouping.

FIG. 10 is an illustration of the consolidated layer group 100 having one woven spike resistant textile layer 110, one adhesive layer 120 and two unidirectional nonwoven knife resistant textile layers 130. The knit knife resistant textile layer 130 contains fiber elements 131 being a core/shell type fiber have a base layer 131*a* and a covering layer 131*b*. The spike resistant textile layer 110 and one of the knife resistant textile layers 130 form the outer surfaces of the layer grouping. There may be an additional layer of adhesive 120 located between the knife resistant textile layers 130 (not shown).

FIG. 11 is an illustration of the consolidated layer group 100 having two woven spike resistant textile layers 110, one adhesive layer 120 and one woven knife resistant textile layer 130. One of the spike resistant textile layers 110 and the knife resistant textile layer 130 form the outer surfaces of the layer grouping.

In one particularly preferred embodiment, the flexible spike and knife resistant composite 10 contains a stack of at least ten consolidated layer groupings 100. Each layer grouping has a normalized stiffness of less than about 5 g/g/m$^2$ as tested by a modified ASTM Test Method D6828-02 and contains one or two spike resistant textile layers, at least one adhesive layer, and one or two knife resistant textile layers. The spike resistant textile layers contains a plurality of woven yarns or fibers, where the yarns or fibers have a tenacity of about eight or more grams per denier and the yarns or fibers have a size of less than about ten denier per filament. The spike textile layers are either impregnated on both sides and at least some of the internal surfaces with about 10 wt. % or less based on the total weight of the spike resistant textile layer of a coating comprising a plurality of particles having a diameter of about 20 μm or less or are woven with a fabric tightness factor of greater than about 0.75. The knife resistant textile layers contain monoaxially drawn tape elements, the tape elements comprising a polyolefin base layer between at least one covering layer of a heat fusible polyolefin. The tape elements have an aspect ratio of greater than ten and have a size greater than 100 denier per filament. The covering layer(s) is characterized by a softening temperature below that of the base layer to permit fusion bonding upon application of heat and the tape elements within each layer are consolidated to one another by the covering layer.

Additional layers may be added to the flexible spike and knife resistant composite 10 to add additional spike, knife, and/or ballistic resistance or other desired properties. In one embodiment, the flexible composite comprises a flexible ballistic panel as shown in FIG. 12.

Figure 12:
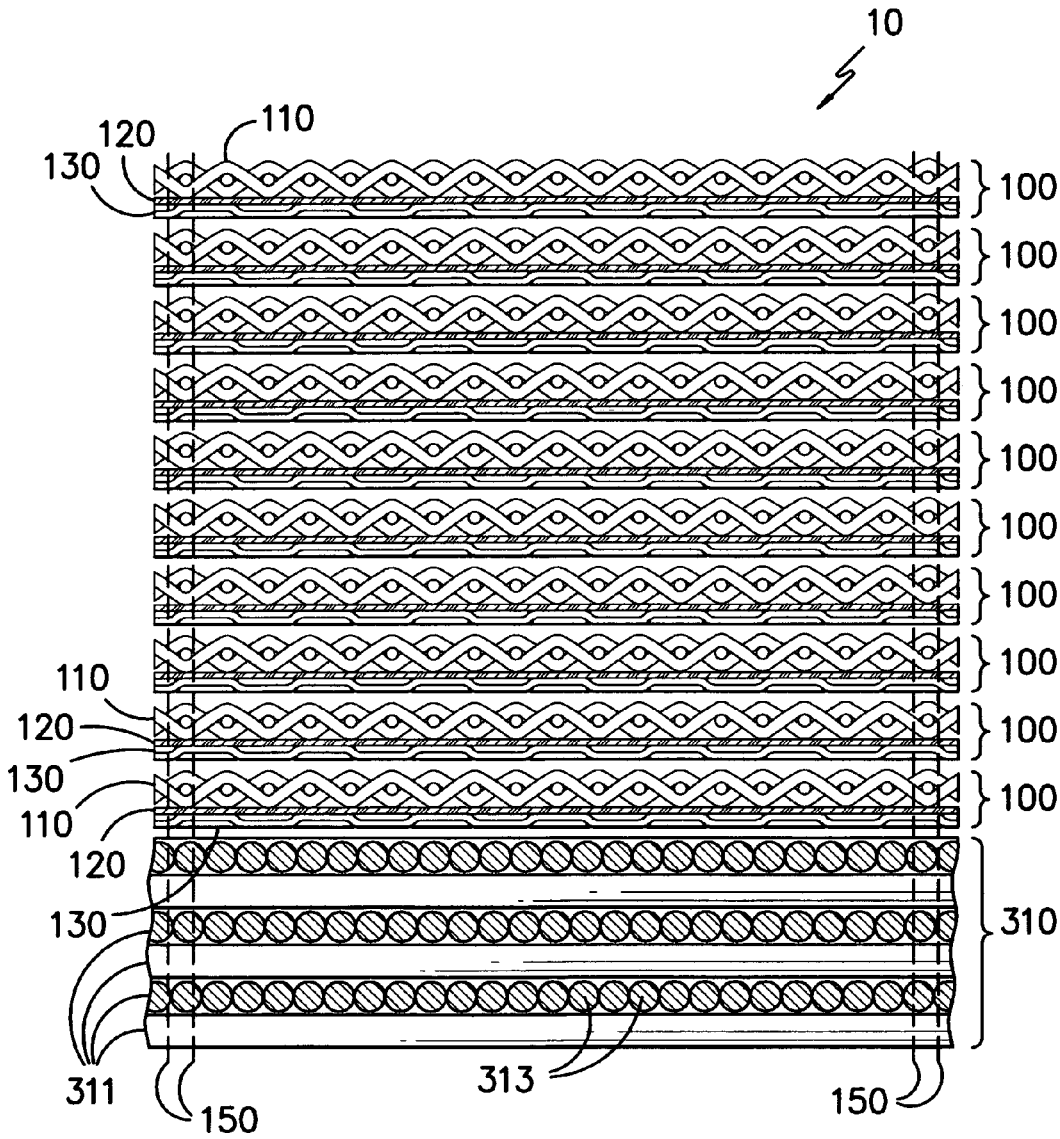
FIG. 12 is a sectional view of a flexible spike and knife resistant composite according to the invention containing a flexible ballistic resistant panel.

An example of a known ballistic resistant material suitable for use in the composite 10 of the invention is the flexible ballistic resistant panel 310 depicted in FIG. 12. In one embodiment, the flexible ballistic resistant panel 310 comprises multiple layers 311 of substantially parallel fibers 313. The fibers 313 suitable for use in the layers 311 can be any of the fibers discussed above as being suitable for use in the textile layers 110, 130 of the composite 10 of the invention, including any suitable combinations of such fibers. While the fibers 313 in layers 311 in FIG. 12 are unidirectional, the fibers 313 may be unidirectional or other nonwoven constructions, woven, or knit. The multiple layers 311 may also include a binder. While the flexible ballistic resistant panel 310 depicted in FIG. 12 is shown with the fibers 313 within layers 311 disposed at an angle of about 90 degrees relative to the fibers 313 of adjacent layers 311, the fibers 311 can be disposed at any suitable angle between 0 and 180 degrees relative to each other.

Commercially-available, flexible ballistic resistant panels such as those described above include, but are not limited to, the SPECTRA SHIELD® high-performance ballistic materials sold by Honeywell International Inc. Such ballistic resistant laminates are believed to be more fully described in U.S. Pat. Nos. 4,916,000 (Li et al.); 5,437,905 (Park); 5,443,882 (Park); 5,443,883 (Park); and 5,547,536 (Park), each of which is herein incorporated by reference. Other commercially available high performance flexible ballistic resistant materials include DYNEEMA UD® available from DSM Dymeema, and GOLDFLEX® available from Honeywell International Inc. These high performance flexible ballistic materials may be used together with the flexible spike and knife resistant composite 10 to enhance overall ballistic performance.

Additional layers may be added to the flexible spike and knife resistant composite 10 to add additional spike and knife resistance. Examples of suitable known puncture resistant materials or components include, but are not limited to, mail (e.g., chain mail), metal plating, ceramic plating, layers of textile materials made from high tenacity yarns which layers have been impregnated or laminated with an adhesive or resin, or textile materials made from low denier high tenacity yarns in a tight woven form such as DuPont KEVLAR CORRECTIONAL® available from DuPont. Such spike and knife resistant materials or components can be attached to adjacent textiles layer using any suitable means, such as an adhesive, stitches, or other suitable mechanical fasteners, or the material or component and textile layers can be disposed adjacent to each other and held in place relative to each other by a suitable enclosure, such as a pocket in a piece of body armor which is adapted to carry a spike, knife, and/or ballistic resistant insert. The flexible spike and knife resistant composite 10 according to the invention can further comprise one or more layers of suitable backing material, such as a textile material (e.g., a textile material made from any suitable natural or synthetic fiber), foam, or one or more plastic sheets (e.g., polycarbonate sheets). For example, the backing material can comprise a plurality of layers of woven or knit polyester textile material which are positioned adjacent to the upper or lower surface of the above-described textile layers. The backing material can also be a trauma pack (e.g., one or more polycarbonate sheets), such as those typically used in body armor. FIG. 13 illustrates the flexible composite 10 comprising 10 layers of consolidated layer groupings 100 and a polycarbonate film 160. In one embodiment, the composite 10 contains additional spike resistant textile layers 110 and/or knife resistant textile layers 130 as described above that are not consolidated or attached to other layers or groupings 100 in the composite 10.

The spike and knife resistant composite 10 with consolidated groupings 100 may be produced by any suitable method or process: One method comprises:

a) forming the spike resistant textile layers containing a plurality of interlocking yarns or fibers having a tenacity of about 8 or more grams per denier and a size of less than ten denier per filament;

b) forming the knife resistant textile layers comprising monoaxially drawn fiber elements, wherein the fiber elements have an aspect ratio of greater than one and have a size greater than 100 denier per filament c) obtaining a adhesive layer to adhere the knife and spike layers together.

d) configuring one or two spike resistant textile layers, at least one adhesive layer and one or two knife resistant textile layers to form an unconsolidated layer grouping. When more than one unconsolidated layer groupings are formed at the same time, a releasing layer may be inserted in between the adjacent unconsolidated layer groupings e) activating (preferably by heat) the adhesive layers to approximately the melting temperature of the adhesive layer to form consolidated layer groupings. The activation process can be a continuous or a batch process.

f) stacking at least five (5) consolidated layer groupings g) optionally attaching the consolidated layer groupings by a fastening means to form the flexible spike and knife resistant composite. The consolidated layer groupings can also be disposed adjacent to each other and held in place relative to each other by a suitable enclosure, such as a pocket.

The process to form the spike resistant layers 110 where the spike resistant layers 110 comprising a plurality of interwoven yarns or fibers having a tenacity of about 8 or more grams per denier, wherein at least one of the surfaces of the spike resistant textile layer comprises about 10 wt. % or less, based on the total weight of the textile layer, of a coating comprising a plurality of particles having a diameter of about 20 μm or less comprises the steps of (a) providing a first textile layer, (b) contacting at least one of the lower surface of the first textile layer with a coating composition comprising a plurality of particles having a diameter of about 20 μm or less, and (c) drying the textile layer treated in step (b) to produce a coating on the lower surface of the first textile layer or the upper surface of the second textile layer.

The surface(s) of the textile layer(s) can be contacted with the coating composition in any suitable manner. The textile layers can be contacted with the coating composition using conventional padding, spraying (wet or dry), foaming, printing, coating, and exhaustion techniques. For example, the textile layer(s) can be contacted with the coating composition using a padding technique in which the textile layer is immersed in the coating composition and then passed through a pair of nip rollers to remove any excess liquid. In such an embodiment, the nip rollers can be set at any suitable pressure, for example, at a pressure of about 280 kPa (40 psi). Alternatively, the surface of the textile layer to be coated can be first coated with a suitable adhesive, and then the particles can be applied to the adhesive.

The coated textile layer(s) can be dried using any suitable technique at any suitable temperature. For example, the textile layer(s) can be dried on a conventional tenter frame or range at a temperature of about 160° C. (320° F.) for approximately five minutes. The formed spike resistant textile layer comprises about 10 wt. % or less, based on the total weight of the textile layer, of a coating comprising a plurality of particles having a diameter of about 20 μm or less may be found in US Patent Publication 2007/0105471 (Wang et al.), incorporated herein by reference.

The process to form the knife resistant textile layers comprising monoaxially drawn fiber elements, the fiber elements comprising a base layer and at least one covering layer of a heat fusible polymer, where the covering layer is characterized by a softening temperature below that of the base layer to permit fusion bonding upon application of heat is described in more detail in U.S. Patent Publication No. 2007/0071960 (Eleazer et al.), U.S. patent application Ser. No. 11/519,134 (Eleazer et al.), and U.S. Pat. Nos. 7,300,691 (Eleazer et al.), 7,294,383 (Eleazer et al.), and 7,294,384 (Eleazer et al.), each of which is incorporated by reference.

Consolidation of layer groupings 100 are preferably carried out at suitable temperature and pressure conditions to facilitate both interface bonding fusion and partial migration of the melted adhesive layer 120 between the textile layers 110, 130. Heated batch or platen presses may be used for multi-layer consolidation. However, it is contemplated that any other suitable press may likewise be used to provide appropriate combinations of temperature and pressure. According to a potentially preferred practice, heating is carried out at a temperature of about 130-160° C. and a pressure of about 0.5-70 bar. According to a potentially preferred practice, cooling is carried out under pressure to a temperature less than about 115° C. It is contemplated that maintaining pressure during the cooling step tends to inhibit shrinkage. Without wishing to be limited to a specific theory, it is believed that higher pressures may facilitate polymer flow at lower temperatures. Thus, at the higher end of the pressure range, (greater than about 20 bar) the processing temperature may be about 90-135° C. Moreover, the need for cooling under pressure may be reduced or eliminated when these lower temperatures are utilized. The temperature operating window to fuse the sheets is wide allowing for various levels of consolidation to occur thus achieving either a more structural panel or one that would delaminate more with impact.

The layered groupings 100 may be consolidated individually, or a number of layered groupings may be consolidated at the same time using release layers between the layered groupings that are then removed before forming the flexible composite 10. One possible method of consolidation involves applying heat and pressure are simultaneously applied to the sample thorough a pair of platens. In other embodiments where the adhesive layer is activated in a method other than heat (such as UV curing), the layers are held together while the adhesive is activated to form the consolidated layer grouping. Other known consolidation techniques that involve heat and pressure, which include, but not limited to, laminating and autoclave.

The consolidated layer grouping 100 can be disposed adjacent to each other and held in place relative to each other by a suitable enclosure, such as a pocket or can be attached to each other by any known fastening means 150. In certain possibly preferred embodiments the consolidated layer groupings 100 can also be sewn together in a desired pattern, for example, around the corners or along the perimeter of the stacked textile layers in order to secure the layers in the proper or desired arrangement. Additionally, the groupings 100 may be adhered together using a patterned adhesive or other fastening means such as rivets, bolts, wires, or clamps.

EXAMPLES

Various embodiments of the invention are shown by way of the Examples below, but the scope of the invention is not limited by the specific Examples provided herein.

Test Methods

Consolidated Layer Groupings Stiffness Test Method

The stiffness of the consolidated layer groupings was measured according to the modified ASTM Test Method D6828-02, entitled "Standard Test Method for Stiffness of Fabric by Blade/Slot Procedure". The sample size used was 1 inch by 4 inch and the width of the slot was set to 20 mm. In order to minimize the effect due to surface friction, a thin Teflon sheet was inserted between the sample and the slot during measurements. For nonsymmetrical configurations, the stiffness value listed is an average of the stiffness measurements in all orientations.

Knife and Stab Resistance Test Method

The stacked consolidated layer groupings (The number of consolidated layer groupings was chosen such that the total areal density is approximately 6.40 kg/m$^2$) were encased in a nylon bag and then tested for knife and spike stab resistance according to NIJ Standard 0115.00 (2000), entitled "Stab Resistance of Personal Body Armor". The stab energy of the drop mass was set at 50 J (Protection level 2 at "E2" overtest strike energy) and at 0 degree incidence. The engineered P1B knife blade and the NIJ engineered spike were used as the threat weapons. The consolidated groupings were arranged such that the knife resistant layers faced the threat (formed the strike face).

Layer Materials

SR-1A

First Spike Resistant Layer

A KEVLAR® fabric HEXCEL STYLE 726® available from Hexcel Corporation located in Anderson, S.C., was obtained. The Kevlar fabric (Hexcel Style 726) was comprised of KEVLAR 129® 840 denier warp and fill yarns woven together in a plain weave construction with 26 ends/inch and 26 picks/inch. The KEVLAR 129® fiber has a tensile strength of approximately 27 grams per denier (g/d) and an initial tensile modulus of approximately 755 g/d. The fabric weighs 6.0 oz/yd$^2$. A spike resistant layer was prepared by coating the KEVLAR® fabric in a bath comprising:

a) approximately 200 grams (or 20%) of CAB-O-SPERSE PG003®, a fumed alumina dispersion (40% solids) with 150 nm particle size available from Cabot Corporation, b) 20 grams (or 2%) MILLITEX RESIN MRX®, a blocked isocyanate based cross-linking agent (35-45% by wt. solids) available from Milliken Chemical, and c) approximately 780 grams of water The solution was applied using a padding process (dip and squeeze at a roll pressure of 40 psi). The fabric was then dried at 320° F. The dry weight add-on of the chemical on the fabric was approximately 3%. The coated fabric layer will be designated as SR-1A in the following examples.

SR-1B

Second Spike Resistant Layer

A KEVLAR® fabric HEXCEL STYLE 310® available from Hexcel Corporation located in Anderson, S.C., was obtained. The Kevlar fabric (Hexcel Style 310) was comprised of KEVLAR COMFORT 400 denier warp and fill yarns woven together in a plain weave construction with 35.5 ends/inch and 35.5 picks/inch. It is believed that the KEVLAR COMFORT fiber has similar tensile and modulus properties as KEVLAR 129® fiber. The fabric weighs 3.6 oz/yd$^2$. A spike resistant layer was prepared by coating the KEVLAR® fabric in a bath comprising:

a) approximately 200 grams (or 20%) of CAB-O-SPERSE PG003®, a fumed alumina dispersion (40% solids) with 150 nm particle size available from Cabot Corporation, b) 20 grams (or 2%) MILLITEX RESIN MRX®, a blocked isocyanate based cross-linking agent (35-45% by wt. solids) available from Milliken Chemical, and c) approximately 780 grams of water The solution was applied using a padding process (dip and squeeze at a roll pressure of 40 psi). The fabric was then dried at 320° F. The dry weight add-on of the chemical on the fabric was approximately 3%. The coated fabric layer will be designated as SR-1B in the following examples.

AD-1

First Adhesive Layer

The first adhesive layer was an eighteen micrometer (18 μm) adhesive film with an areal density of approximately 0.47 oz/yard$^2$ made from EXCEED 1018CA® available from Exxon Mobile. EXCEED® 1018CA is an ethylene based polymer produced with metallocene single site catalysts using ExxonMobil's EXXPOL® technology having a peak melting temperature of 244° F. The adhesive layer will be designated as AD-1 in the following examples.

AD-2

Second Adhesive Layer

The second adhesive layer was a web VI 6010-060-039° available from SPUNFAB® of Cuyahoga Falls, Ohio. VI 6010-060-039® is a hot melt type of adhesive web made of polyester, polyamide and a third proprietary polymer. It has a areal density of approximately 0.6 oz/yard$^2$. The melting point of the adhesive web is between 280° F. and 300° F.

KR-1

First Knife Resistant Layer

The first knife resistant layer was a woven fabric layer made of 1020 denier 2.2 mm wide tape yarns. The tape yarns had a thickness of 65 μm with a polypropylene core layer surrounded by two polypropylene copolymer surface layers. The surface layers comprised about 15% by thickness of the total tape element. The tape yarns were woven in a 2×2 twill pattern with 11 ends/inch and 11 picks/inch. The yarn has a tensile strength of approximately 7 g/d and a tensile modulus of approximately 126 g/d. The fabric weighs 3 oz/yd$^2$. The resultant woven layer is designated as KR-1 in the following examples.

KR-2

Second Knife Resistant Layer

The second knife resistant layer was a unidirectional fabric layer made of 1020 denier 2.2 mm wide tape yarns. The tape yarns had a thickness of 65 μm with a polypropylene core layer surrounded by two polypropylene copolymer surface layers. The surface layers comprised about 15% by thickness of the total tape element. The tape yarns were placed in a unidirectional configuration with 11.5 ends/inch. A nine (9) micrometer (μm) thick polyethylene film was used to back two layers of such unidirectional configuration resulting in a fabric weighing 3.2 oz/yd$^2$. The tape yarns had a tensile strength of approximately 7 g/d and a tensile modulus of approximately 126 g/d. The unidirectional layer is designated as KR-2 in the following examples.

KR-3

Third Knife Resistant Layer

The third knife resistant layer was a woven fabric layer made of 970 denier 1.6 mm wide carbon black filled polypropylene tape yarns with a thickness of 65 p.m. The tape yarns were woven in a plain weave pattern with 15 ends/inch and 14 picks/inch. The fabric weighs approximately 4.6 oz/yd$^2$. The yarn has a tensile strength of approximately 5.5 g/d and a tensile modulus of approximately 44 g/d. The resultant woven layer is designated as KR-3 in the following examples.

PC-1

First Polycarbonate Layer

The first polycarbonate layer was a five (5) mil (Approximately 125 micrometers) thick polycarbonate film available from McMaster-Carr, Atlanta, Ga.

Invention and Comparative Examples

Invention Example 1

An unconsolidated layer grouping was formed by stacking in order an SR-1A layer, an AD-1 layer, and an KR-1 layer. The unconsolidated layer grouping was consolidated into a consolidated layer grouping by a compression molding process with 300° F. Platen temperature and 300 psi pressure.

The consolidated layer grouping had an areal density of 0.32 kg/m$^2$. The stiffness and normalized stiffness with respect to its areal density for Invention Example 1 is shown in Table 1. Twenty (20) consolidated layer groupings with a total areal density of 6.40 kg/m$^2$ were stacked together (with the KR-1 layer oriented as the strike face) and encased in a nylon bag. The assembly was then tested for knife and spike stab resistance. The penetrations of the P1B knife and spike are shown in Table 2.

Invention Example 2

An unconsolidated layer grouping for Invention Example 2 was formed by stacking in order a SR-1A layer, a AD-1 layer, a KR-1 layer, an AD-1 layer, and an SR-1A layer. The unconsolidated layer grouping was consolidated into a consolidated layer grouping by a compression molding process with 300° F. Platen temperature and 300 psi pressure.

The consolidated layer grouping had an areal density of 0.54 kg/m$^2$. The stiffness and normalized stiffness with respect to its areal density for Invention Example 2 is shown in Table 1. Twelve (12) consolidated layer groupings with a total areal density of 6.48 kg/m$^2$ were stacked together and encased in a nylon bag. The assembly was then tested for knife and spike stab resistance. The penetrations of the P1B knife and spike are shown in Table 2.

Invention Example 3

An unconsolidated layer grouping for Invention Example 3 was formed by stacking in order a SR-1A layer, an AD-2 layer, a PC-1 layer, an AD-2 layer, and a KR-1 layer. The unconsolidated layer grouping was consolidated into a consolidated layer grouping by a compression molding process with 300° F. Platen temperature and 300 psi pressure.

The consolidated layer grouping had an areal density of 0.495 kg/m$^2$. The stiffness and normalized stiffness with respect to its areal density for Invention Example 3 is shown in Table 1. Thirteen (13) consolidated layer groupings with a total areal density of 6.44 kg/m$^2$ were stacked together and encased in a nylon bag. The assembly was then tested for knife and spike stab resistance. The penetrations of the P1B knife and spike are shown in Table 2.

Invention Example 4

An unconsolidated layer grouping for Invention Example 4 was formed by stacking in order an SR-1B layer, an AD-1 layer, and an KR-1 layer. The unconsolidated layer grouping was consolidated into a consolidated layer grouping by a compression molding process with 300° F. Platen temperature and 300 psi pressure.

The consolidated layer grouping had an areal density of 0.245 kg/m$^2$. The stiffness and normalized stiffness with respect to its areal density for Invention Example 4 is shown in Table 1. Twenty six (26) consolidated layer groupings with a total areal density of 6.37 kg/m$^2$ were stacked together and encased in a nylon bag. The assembly was then tested for knife and spike stab resistance. The penetrations of the P1B knife and spike are shown in Table 2.

Invention Example 5

An unconsolidated layer grouping for Invention Example 5 was formed by stacking in order an SR-1B layer, a AD-1 layer, a KR-1 layer, an AD-1 layer, and an SR-1B layer. The unconsolidated layer grouping was consolidated into a consolidated layer grouping by a compression molding process with 300° F. Platen temperature and 300 psi pressure.

The consolidated layer grouping had an areal density of 0.39 kg/m$^2$. The stiffness and normalized stiffness with respect to its areal density for Invention Example 5 is shown in Table 1. Sixteen (16) consolidated layer groupings with a total areal density of 6.25 kg/m$^2$ were stacked together and encased in a nylon bag. The assembly was then tested for knife and spike stab resistance. The penetrations of the P1B knife and spike are shown in Table 2.

Invention Example 6

An unconsolidated layer grouping for Invention Example 6 was formed by stacking in order an a KR-1 layer, an AD-1 layer, a SR-1B layer, an AD-1 layer, and a KR-1 layer. The unconsolidated layer grouping was consolidated into a consolidated layer grouping by a compression molding process with 300° F. Platen temperature and 300 psi pressure.

The consolidated layer grouping had an areal density of 0.36 kg/m$^2$. The stiffness and normalized stiffness with respect to its areal density for Invention Example 6 is shown in Table 1. Eighteen (18) consolidated layer groupings with a total areal density of 6.48 kg/m$^2$ were stacked together and encased in a nylon bag. The assembly was then tested for knife and spike stab resistance. The penetrations of the P1B knife and spike are shown in Table 2.

Invention Example 7

An unconsolidated layer grouping for Invention Example 7 was formed by stacking in order an SR-1B layer, an AD-1 layer, a KR-2 layer, and a KR-2 layer (with the directional of the unidirectional tape elements perpendicular to the previous KR-2 layer). The two unidirectional layers (with the fibers perpendicular) formed one knife resistant layer. The unconsolidated layer grouping was consolidated into a consolidated layer grouping by a compression molding process with 300° F. Platen temperature and 300 psi pressure.

The consolidated layer grouping had an areal density of 0.365 kg/m$^2$. The stiffness and normalized stiffness with respect to its areal density for Invention Example 7 is shown in Table 1. Twelve (12) consolidated layer groupings with a total areal density of 6.57 kg/m$^2$ were stacked together and encased in a nylon bag. The assembly was then tested for knife and spike stab resistance. The penetrations of the P1B knife and spike are shown in Table 2.

Invention Example 8

An unconsolidated layer grouping for Invention Example 8 was formed by stacking in order an SR-1B layer, an AD-1 layer, and an KR-3 layer. The unconsolidated layer grouping was consolidated into a consolidated layer grouping by a compression molding process with 300° F. Platen temperature and 300 psi pressure.

The consolidated layer grouping had an areal density of 0.297 kg/m$^2$. The stiffness and normalized stiffness with respect to its areal density for Invention Example 8 is shown in Table 1. Twenty two (22) consolidated layer groupings with a total areal density of 6.53 kg/m$^2$ were stacked together and encased in a nylon bag. The assembly was then tested for knife and spike stab resistance.

Comparative Example 1

Thirty one (31) layers of SR-1A were loosely stacked together with a total areal density of 6.39 kg/m$^2$ and encased in a nylon bag. The assembly was then tested for knife and spike stab resistance. The penetrations of the P1B knife and spike are shown in Table 2.

Comparative Example 2

Sixty four (64) layers of KR-1 were loosely stacked together with a total areal density of 6.43 kg/m$^2$ and encased in a nylon bag and tested for knife and spike resistance. The penetrations of the P1B knife and spike are shown in Table 2.

Comparative Example 3

Twenty one (21) layers of KR-1 and twenty one (21) layers of SR-1A were loosely stacked in an alternating configuration (KR-1, SR-1A, KR-1, SR-1A . . . ). The resultant stack had a total areal density of 6.44 kg/m$^2$. The unconsolidated assembly was encased in a nylon bag and tested for knife and spike resistance. The penetrations of the P1B knife and spike are shown in Table 2.

Discussion of Results

The following table shows the stiffness and normalized stiffness for each of the Invention Examples tested according to the Consolidated Layer Groupings Stiffness Test Method described above.

TABLE 1

Stiffness and normalized stiffness of consolidated layer groupings of Invention Examples

| | Stiffness (g) | Normalized Stiffness (g/g/m$^2$) |
|---|---|---|
| Inv. Ex. 1 | 215 | 0.67 |
| Inv. Ex. 2 | 606 | 1.12 |
| Inv. Ex. 3 | 560 | 1.13 |
| Inv. Ex. 4 | 148 | 0.60 |
| Inv. Ex. 5 | 376 | 0.96 |
| Inv. Ex. 6 | 719 | 2.00 |
| Inv. Ex. 7 | 405 | 1.11 |
| Inv. Ex. 8 | 148 | 0.50 |

TABLE 2

Knife and Spike Penetration test for Invention and Comparison Examples

| | P1B knife Penetration (mm) | Spike Penetration (mm) |
|---|---|---|
| Inv. Ex. 1 | 22 | 28 |
| Inv. Ex. 2 | 25 | 31 |
| Inv. Ex. 3 | 23 | 35.5 |
| Inv. Ex. 4 | 19 | 25.5 |
| Inv. Ex. 5 | 21.5 | 29 |
| Inv. Ex. 6 | 16 | 30 |
| Inv. Ex. 7 | 14 | 26.5 |
| Inv. Ex. 8 | 25.5 | 31 |
| Comp. Ex. 1 | 40 | ~0 |
| Comp. Ex. 2 | 33 | 50 |
| Comp. Ex. 3 | 55 | 33.5 |

Comparative Example 1 illustrates that SR-1A is an excellent spike resistant material (approx. 0 mm of penetration), but has relatively poor knife resistance (40 mm of penetration). The Comparative Example 2 shows that the KR-1 fabric, on the other hand, has better knife resistance (33 mm penetration) with very poor spike resistance (50 mm penetration). When SR-1A and KR-1 materials are loosely combined together without consolidation, as shown in Comparative Example 3, the knife resistant performance is reduced significantly. The two components work antagonistically instead of synergistically.

Invention Examples 1 and 2 clearly demonstrate that when the SR-1A and KR-1 are combined together with adhesive layers in a consolidated layer grouping and then consolidated layer groupings are stacked without consolidation, the knife resistance performance improved dramatically while still have good spike resistance and flexibility. The components work synergistically instead of antagonistically. Same or better knife resistant performance was found for SR-1B and KR-1 consolidated layer groupings as shown in Invention Examples 4, 5 and 6. Invention Example 7 demonstrates that KR-2 (Unidirectional) fabrics may be used in addition to the woven layers to make consolidated layer groupings. Other tough materials such as polycarbonate sheet can also be incorporated into making consolidated layer groupings as shown in Invention Example 3.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A flexible spike and knife resistant composite comprising a stack of at least ten (10) consolidated layer groupings, wherein each layer grouping has a normalized stiffness of less than about 5 g/g/m$^2$ as tested by a modified ASTM Test Method D6828-02 and comprises:

one or two spike resistant textile layers, each layer comprising a plurality of interlocked yarns or fibers, wherein the yarns or fibers have a tenacity of about 8 or more grams per denier and the fiber size is less than ten denier per filament, at least one adhesive layer;

one or two knife resistant textile layers comprising monoaxially drawn fiber elements, wherein the fiber elements have an aspect ratio of greater than one and have a size greater than 100 denier per filament and, wherein the fiber elements are bonded to each other or to the spike resistant layer.

2. The flexible spike and knife resistant composite of claim 1, wherein the fiber elements of the knife resistant textile layer are comprised of a base layer and at least one covering layer of a heat fusible polymer wherein the covering layer is characterized by a softening temperature below that of the base layer to permit fusion bonding upon application of heat, wherein the fiber elements within each layer are consolidated to one another by the covering layer.

3. The flexible spike and knife resistant composite of claim 1, wherein the adhesive layer is a thermoplastic and has a lower melting temperature than the base layer of the fiber elements.

4. The flexible spike and knife resistant composite of claim 1, wherein the spike resistant textile layer is woven.

5. The flexible spike and knife resistant composite of claim 1, wherein the spike resistant textile layer has a fabric tightness factor of greater than about 0.75.

6. The flexible spike and knife resistant composite of claim 1, wherein the spike resistant textile layer comprises aramid fibers.

7. The flexible spike and knife resistant composite of claim 1, wherein the spike resistant textile layers comprise a plurality of interlocking yarns or fibers having a tenacity of about 10 or more grams per denier.

8. The flexible spike and knife resistant composite of claim 1, wherein the monoaxially drawn fiber elements comprise polypropylene.

9. The flexible spike and knife resistant composite of claim 1, wherein the spike resistant textile layer is impregnated on both sides and at least some of the internal surfaces with about 10 wt. % or less, based on the total weight of the spike resistant textile layer, of a coating comprising a plurality of particles having a diameter of about 20 μm or less.

10. The flexible spike and knife resistant composite of claim 9, wherein the particles are selected from the group consisting of fumed alumina and fumed silica.

11. The flexible spike and knife resistant composite of claim 1, further comprising a flexible ballistic panel.

12. The flexible spike and knife resistant composite of claim 1, wherein at least one layer grouping comprises in order: one spike resistant textile layer, one adhesive layer and one knife resistant textile layer, wherein the spike resistant and the knife resistant textile layers form the outer surfaces of the layer grouping.

13. The flexible spike and knife resistant composite of claim 1, wherein at least one layer grouping comprises in order: one spike resistant textile layer, one adhesive layer and one knife resistant textile layer, one adhesive layer, and one spike resistant textile layer, wherein the spike resistant textile layers form the outer surfaces of the layer grouping.

14. The flexible spike and knife resistant composite of claim 1, wherein at least one layer grouping comprises in order: one knife resistant textile layer, one adhesive layer and one spike resistant textile layer, one adhesive layer, and one knife resistant textile layer, wherein the knife resistant textile layers form the outer surfaces of the layer grouping.

15. The flexible spike and knife resistant composite of claim 1, wherein the layer groupings are attached to one another by a fastening apparatus selected from the group consisting of stitches, patterned adhesive, fabric or film pouch, and fasteners.

16. A flexible spike and knife resistant composite comprising a stack of at least five (5) consolidated layer groupings, wherein each layer grouping has a normalized stiffness of less than about 5 g/g/m$^2$ as tested by a modified ASTM Test Method D6828-02 and comprises:

one or two spike resistant textile layers, each layer comprising a plurality of woven yarns or fibers, wherein the yarns or fibers have a tenacity of about eight or more grams per denier and the yarns or fibers have a size of less than about ten denier per filament, and wherein the spike textile layers are either impregnated on both sides and at least some of the internal surfaces with about 10 wt. % or less based on the total weight of the spike resistant textile layer of a coating comprising a plurality of particles having a diameter of about 20 μm or less or are woven with a fabric tightness factor of greater than about 0.75;

at least one adhesive layer;

one or two knife resistant textile layer comprising monoaxially drawn tape elements, the tape elements comprising a polyolefin base layer between at least one covering layer of a heat fusible polyolefin, wherein the tape elements have an aspect ratio of greater than ten and have a size greater than 100 denier per filament, wherein the covering layers are characterized by a softening temperature below that of the base layer to permit fusion bonding upon application of heat, wherein the tape elements within each layer are consolidated to one another by the covering layer.

17. The flexible spike and knife resistant composite of claim 16, wherein the adhesive layer is a thermoplastic and has a lower melting temperature than the base layer of the tape elements.

18. The flexible spike and knife resistant composite of claim 16, wherein at least one layer grouping comprises in order: one spike resistant textile layer, one adhesive layer and one knife resistant textile layer, wherein the spike resistant and the knife resistant textile layers form the outer surfaces of the layer grouping.

19. The flexible spike and knife resistant composite of claim 16, wherein the layer groupings are attached to one another by a fastening apparatus selected from the group consisting of stitches, patterned adhesive, fabric or film pouch, and fasteners.

20. The flexible spike and knife resistant composite of claim 16, further comprising at least one polycarbonate layer.

* * * * *